US011480896B2

(12) United States Patent
Mitsumata et al.

(10) Patent No.: US 11,480,896 B2
(45) Date of Patent: Oct. 25, 2022

(54) BELT CONVEYANCE APPARATUS AND IMAGE FORMING APPARATUS

(71) Applicant: CANON KABUSHIKI KAISHA, Tokyo (JP)

(72) Inventors: Akinori Mitsumata, Tokyo (JP); Takeo Kawanami, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/365,748

(22) Filed: Jul. 1, 2021

(65) Prior Publication Data

US 2022/0004125 A1 Jan. 6, 2022

(30) Foreign Application Priority Data

Jul. 6, 2020 (JP) ..... JP2020-116592

(51) Int. Cl.
*G03G 15/20* (2006.01)
*G03G 15/16* (2006.01)

(52) U.S. Cl.
CPC ..... *G03G 15/1615* (2013.01)

(58) Field of Classification Search
CPC ..... G03G 15/0131; G03G 15/1615; G03G 2215/0119; G03G 2215/0161
USPC ..... 399/297, 302, 303, 308, 310, 312, 313
See application file for complete search history.

(56) References Cited

U.S. PATENT DOCUMENTS 9,256,184 B2 * 2/2016 Iwakoshi ..... G03G 15/1615
9,840,387 B2 * 12/2017 Shigihara ..... G03G 15/6529

FOREIGN PATENT DOCUMENTS

JP 2004203567 * 7/2004
JP 2012032437 A 2/2012
JP 2014106482 A 6/2014
JP 2016189017 A 11/2016

* cited by examiner

*Primary Examiner* — Hoan H Tran
(74) *Attorney, Agent, or Firm* — Canon U.S.A., Inc. I.P. Division

(57) ABSTRACT

A belt conveyance apparatus includes an endless belt, bearings, first and second adjustment members, and a stretching member. The first and second adjustment members are each rotatably supported by an outer circumferential surface of the bearings, face an end portion of the endless belt, and include a sliding surface. The stretching member includes a rotation unit. On a first end side or a second end side opposite to the first end side in a belt width direction, a distance from a first end portion which is an end portion of the rotation unit at a position closest to the sliding surface to the sliding surface is shorter than a distance from a second end portion at a position farthest from the sliding surface of the first adjustment member or the second adjustment member to the sliding surface.

10 Claims, 18 Drawing Sheets

BELT CONVEYANCE APPARATUS AND IMAGE FORMING APPARATUS

BACKGROUND

Field

The present disclosure relates to a belt conveyance apparatus which rotationally moves an endless belt while stretching the belt by a plurality of stretching members and an image forming apparatus, such as a printer and a copying machine, which adopts an electrophotographic method and is provided with the belt conveyance apparatus.

Description of the Related Art

Some typical image forming apparatuses, such as printers and copying machines, which adopt an electrophotographic method use belt conveyance apparatuses that rotationally move endless belts while stretching the belt by a plurality of stretching members. For such belt conveyance apparatuses, a belt is shifted toward one end side in a belt width direction (an axial direction of a stretching roller) orthogonal to a belt movement direction in a case where the belt is rotationally moved, which is a known issue.

In order to address the issue, for example, Japanese Patent Application Laid-Open No. 2014-106482 discusses a configuration which with which a shift of a belt is adjusted using a force (rotation torque) in a movement direction of the belt. Specifically, Japanese Patent Application Laid-Open No. 2014-106482 discusses the configuration which includes first and second adjustment members which are provided on both sides of one stretching member in a belt width direction and can rotate by receiving a force in the movement direction from the belt and a link unit which links a movement of the first adjustment member with a movement of the second adjustment member. According to the configuration discussed in Japanese Patent Application Laid-Open No. 2014-106482, in a case where the belt is shifted to one end side, and a belt end portion comes into contact with the first adjustment member in the belt width direction, the second adjustment member is rotationally moved in conjunction with a rotational movement of the first adjustment member, so that the one stretching member is tilted with respect to the other stretching member. Accordingly, a shift of the belt can be adjusted.

According to Japanese Patent Application Laid-Open No. 2014-106482, a support length of the adjustment member, by which the adjustment member is supported by a bearing, is set to a predetermined length or more in order to prevent the first and second adjustment members (hereinbelow, simply referred to as the adjustment members) from tilting outward in the belt width direction in a case where the adjustment members receive a shifting force from the belt in the rotational movement of the adjustment members. Thus, it is possible to reduce or prevent the tilt of the adjustment members and secure a stable operation performance.

However, according to the configuration discussed in Japanese Patent Application Laid-Open No. 2014-106482, the adjustment member having the above-described predetermined support length increases a distance between an end portion of the stretching member stretching the belt and a belt end portion contacting surface of the adjustment member in the belt width direction, and thus, there is a concern about a following issue. In a case where a belt with a weak end portion strength and the like is used, the end portion of the belt to which a stretching force is not applied by the stretching member may easily buckle.

SUMMARY

The present disclosure is directed to providing a belt conveyance apparatus which can prevent buckling of a belt end portion while maintaining an operation performance of an adjustment member which adjusts a shift of a belt. For example, to reduce or prevent the buckling of the belt end portion, it is desirable that a distance from an end portion of a stretching member to a belt end portion contacting surface of the adjustment member in a belt width direction is short.

According to an aspect of the present disclosure, a belt conveyance apparatus includes an endless belt configured to rotationally move, a plurality of stretching members for stretching the endless belt, an adjustment mechanism configured to adjust a shift of the endless belt, wherein, in a case where the endless belt is shifted to a first end side in a belt width direction orthogonal to a movement direction of the endless belt, the adjustment mechanism adjusts the shift of the endless belt by tilting one stretching member of the plurality of stretching members with respect to another stretching member, and bearings, wherein each bearing is for supporting a corresponding one of both end sides of the one stretching member in the belt width direction, wherein the adjustment mechanism includes first and second adjustment members and a link unit, wherein the first and second adjustment members are each disposed on the respective both end sides of the one stretching member in the belt width direction and configured to rotate by receiving a force from the endless belt, wherein the link unit is configured to link rotation of the first adjustment member to rotation of the second adjustment member, wherein, in a case where the endless belt is shifted to the first end side, the adjustment mechanism is configured to adjust the shift of the endless belt by tilting the one stretching member with respect to the other stretching member with the first adjustment member rotated by receiving the force from the endless belt and the second adjustment member rotated by the link unit, wherein the first and second adjustment members are each rotatably supported by an outer circumferential surface of the bearings, face an end portion of the endless belt stretched by the plurality of stretching members, and include a sliding surface which comes into contact with the end portion of the endless belt in a case where the endless belt is shifted, wherein the one stretching member includes a rotation unit which supports an inner circumferential surface of the endless belt and rotates with the rotation of the endless belt, and wherein, on the first end side or a second end side opposite to the first end side in the belt width direction, a distance from a first end portion, which is an end portion of the rotation unit at a position closest to the sliding surface, to the sliding surface is shorter than a distance from a second end portion at a position farthest from the sliding surface of the first adjustment member or the second adjustment member to the sliding surface.

Further features of the present disclosure will become apparent from the following description of exemplary embodiments with reference to the attached drawings.

DESCRIPTION OF THE EMBODIMENTS

Various exemplary embodiments of the present disclosure will be described in detail below with reference to the accompanying drawings. Constituent components described in the following exemplary embodiments can be appropriately modified in their dimensions, materials, shapes, and relative layout considering configurations and various conditions of an apparatus to which the present disclosure is applied. Thus, unless otherwise specified, the scope of the present disclosure is not limited to them.

Figure 1:
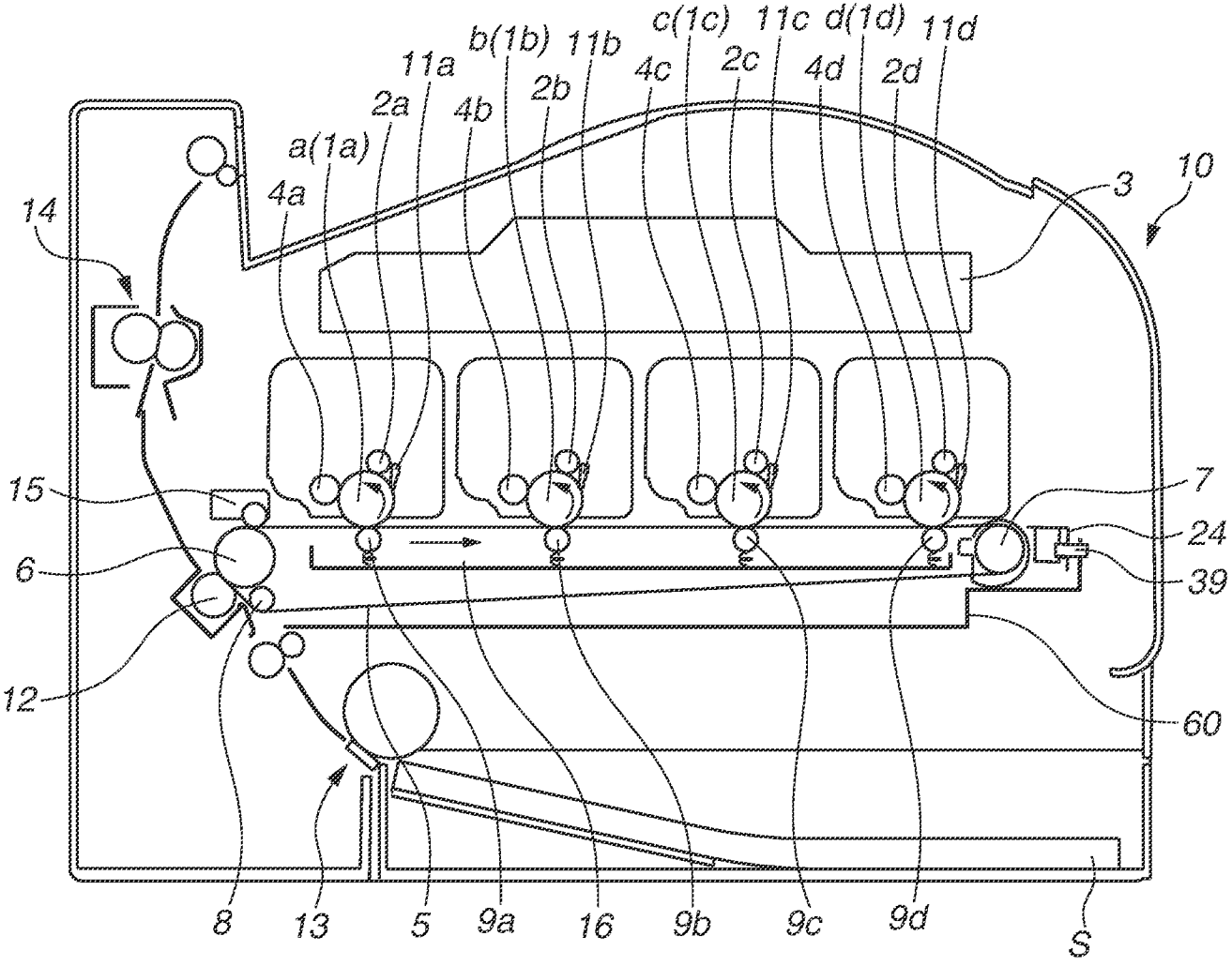
FIG. 1 is a schematic diagram illustrating an image forming apparatus provided with a belt conveyance apparatus according to the present disclosure.

A first exemplary embodiment of an image forming apparatus provided with a belt conveyance apparatus according to the present disclosure will be described. FIG. 1 is a sectional view of an electrophotographic color image forming apparatus adopting an intermediate transfer method. The image forming apparatus includes an intermediate transfer belt unit 16 serving as a belt conveyance apparatus provided with a belt shift adjustment mechanism according to the present disclosure.

[Overall Configuration of Image Forming Apparatus]

The configuration of an image forming apparatus according to the present exemplary embodiment will be described with reference to FIG. 1, which is a schematic diagram illustrating an example of the color image forming apparatus. An image forming apparatus 10 can form an image on a transfer material P, such as a recording sheet and an overhead projector (OHP) sheet, by the electrophotographic method in accordance with signals transmitted from an external apparatus, such as a personal computer connected to the image forming apparatus 10 in a communicable manner.

In the image forming apparatus 10, a plurality of image forming units a, b, c, and d each for forming a toner image of respective colors of yellow, magenta, cyan, and black is arranged linearly in a substantially horizontal direction. The belt conveyance apparatus is arranged to face the respective image forming units a, b, c, and d. The belt conveyance apparatus according to the present exemplary embodiment is a transfer unit in which a belt and other members are unitized.

The transfer unit according to the present exemplary embodiment is the intermediate transfer belt unit 16 which rotationally moves an endless belt (also referred to as an intermediate transfer belt) 5, serving as an intermediate transfer member, stretched by stretching members (a driving roller 6, a tension roller 7, and a driven roller 8) with the endless belt facing each of the image forming units a, b, c, and d. The image forming units a, b, c, and d have the same configuration and exert the same action except that the color of the toner image formed by the respective forming units a, b, c, and d is different. Thus, the configuration of the image forming unit a will be described as a representative.

The image forming unit a forms a toner image through a known electrophotographic image forming process. The image forming unit a includes an cylindrical electrophotographic photosensitive member serving as an image bearing member, namely, a photosensitive drum 1*a*, to be rotatable in a direction of an arrow in FIG. 1. In an image forming operation, first, a charging roller 2*a* serving as a charging unit charges the surface of the rotating photosensitive drum 1*a*. Next, a laser scanner 3 serving as an exposure unit emits light in accordance with a signal transmitted from a computer and performs scanning exposure on the charged photosensitive drum 1*a* to the light, and thus an electrostatic latent image is formed on the photosensitive drum 1*a*. A developing roller 4*a* serving as a developing unit supplies toner as developer to visualize the electrostatic latent image formed on the photosensitive drum 1*a* as a toner image. The toner image visualized on the photosensitive drum 1*a* is electrostatically transferred onto the belt 5 by an action of a primary transfer roller 9*a* serving as a primary transfer unit arranged to face the photosensitive drum 1*a* across the belt 5 in a primary transfer portion T1. Primary transfer residual toner remaining on the surface of the photosensitive drum 1*a* is cleaned and removed by a cleaning device 11*a* and then used in the image forming process after charging.

The toner images formed on the photosensitive drums 1*a*, 1*b*, 1*c*, and 1*d* in the respective image forming units a, b, c, and d are sequentially transferred onto the belt 5 so as to be overlapped with each other at a timing matching the movement of the belt 5 through the above-described process, thus forming a color toner image.

Meanwhile, the transfer material P that has been fed from a transfer material storage unit by a feeding unit and the like is conveyed to a contact portion (a secondary transfer portion) between a secondary transfer roller 12 serving as a secondary transfer unit and the belt 5 in a timely manner. Accordingly, the toner image on the belt 5 is electrostatically transferred to the transfer material P by an action of the secondary transfer roller 12 at the secondary transfer portion T2.

Next, the transfer material P is separated from the belt 5 and conveyed to a fixing unit 14. In the fixing unit 14, the toner image on the transfer material P is pressed and heated and thus firmly fixed onto the transfer material P. Subsequently, the transfer material P is conveyed and discharged to a discharge tray. Secondary transfer residual toner remaining on the surface of the intermediate transfer belt 5 is cleaned and removed by a transfer belt cleaning unit 15.

The intermediate transfer belt unit 16 includes a sensor unit 24 serving as a detection unit. (A method of supporting the sensor unit 24 will be described below.) According to the present exemplary embodiment, the sensor unit 24 is provided at a position facing the tension roller 7 across the intermediate transfer belt 5. The sensor unit 24 can detect information about a toner patch transferred to the intermediate transfer belt 5 and can detect, for example, density of the toner patch. A control unit (a controller) provided in a main body of the image forming apparatus 10 can control density of the toner image by controlling each of the image forming units and the laser scanner 3 based on a detection result of the sensor unit 24.

In the image forming apparatus 10 according to the present exemplary embodiment, the intermediate transfer belt unit 16 can be freely detached from the image forming apparatus 10. In other words, the belt conveyance apparatus is configured to be freely attached to and detached from the image forming apparatus 10. The photosensitive drums 1*a*, 1*b*, 1*c*, and 1*d* and the developing rollers 4*a*, 4*b*, 4*c*, and 4*d* in the respective image forming units a, b, c, and d may be integrated in a cartridge with a frame and formed as a process cartridge that is attachable to and detachable from the image forming apparatus 10.

[Schematic Configuration of Intermediate Transfer Belt Unit]

Next, the configurations of the intermediate transfer belt unit 16 and the belt shift adjustment mechanism will be describe with reference to FIGS. 2 to 7. The intermediate transfer belt unit 16 includes the intermediate transfer belt 5, a plurality of stretching members (the driving roller 6, the tension roller 7, and the driven roller 8) for stretching the intermediate transfer belt 5, and frame members 17R and 17L for supporting the plurality of stretching members. The intermediate transfer belt unit 16 further includes the primary transfer rollers 9*a*, 9*b*, 9*c*, and 9*d*. The intermediate transfer belt unit 16 is configured to be positioned with respect to a main body frame member 60 of the image forming apparatus 10.

Figure 2:
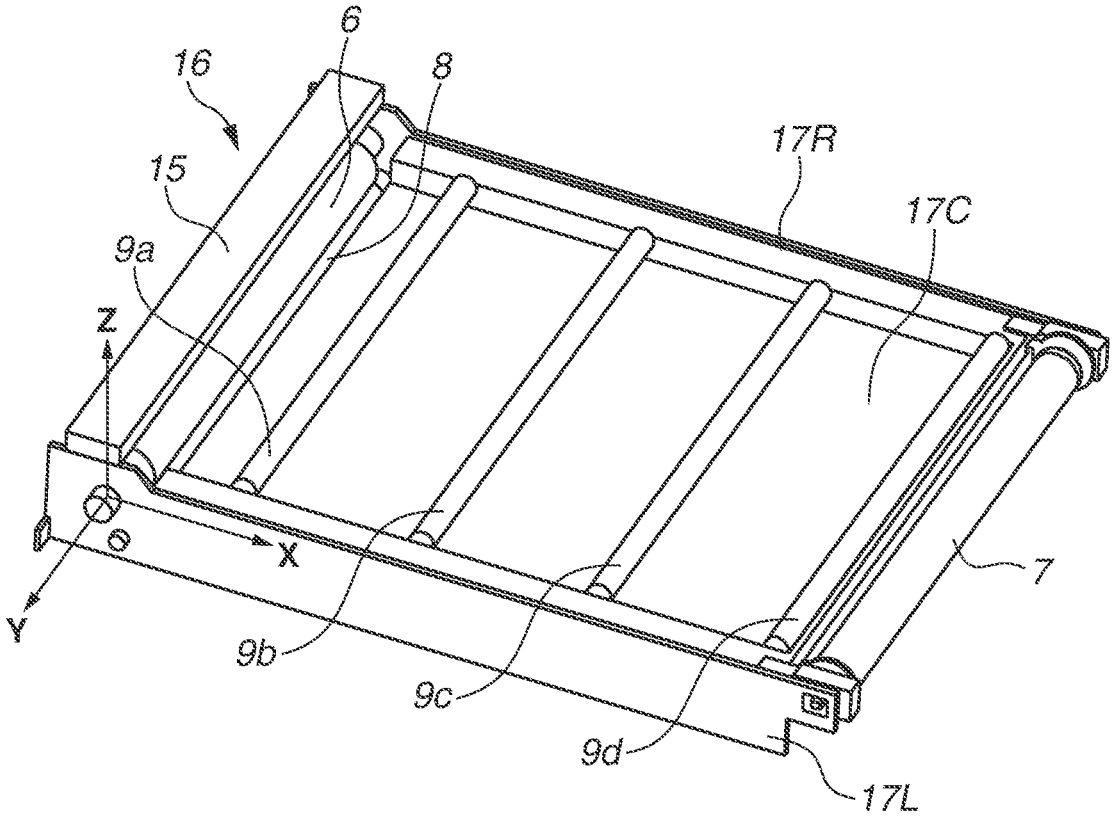
FIG. 2 is a perspective view of an intermediate transfer belt unit according to a first exemplary embodiment.

FIG. 2, which is a perspective view of the intermediate transfer belt unit 16, illustrates an internal mechanism, and thus, the intermediate transfer belt 5 and the sensor unit 24 are not illustrated.

As illustrated in FIG. 2, the driving roller 6 and the driven roller 8 are positioned with respect to the frame members 17L and 17R via bearings. Rotating shafts of the driving roller 6 and the driven roller 8 are each supported by the bearings to be rotatable. The tension roller 7 is supported by adjustment members 21L and 21R described below to be rotatable with respect to the frame members 17R and 17L. The driving roller 6 is driven to rotate by a not-illustrated driving unit to convey the intermediate transfer belt 5. The tension roller 7 and the driven roller 8 are driven by being brought into contact with the intermediate transfer belt 5.

Figure 3:
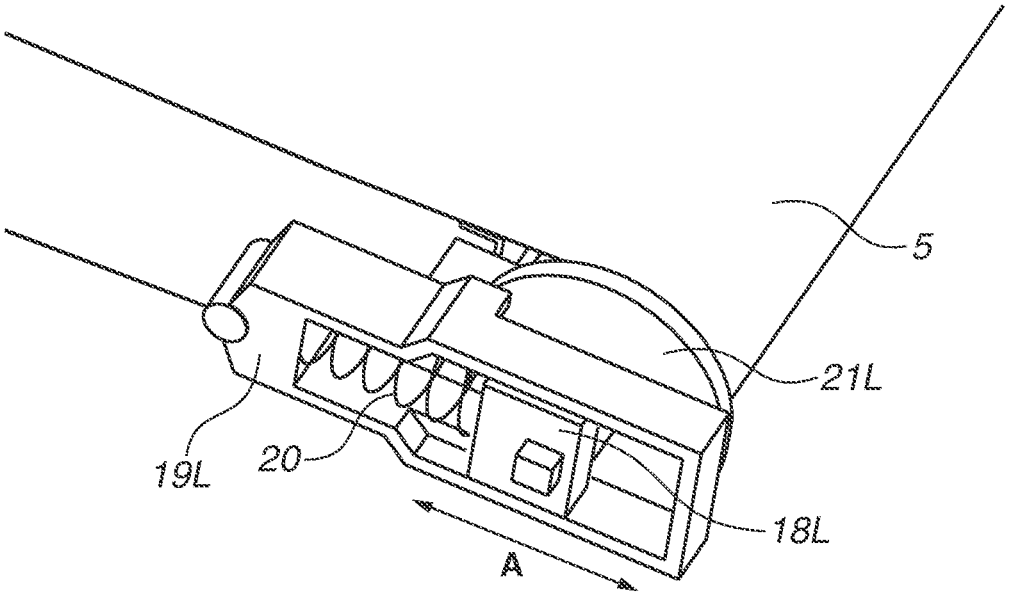
FIG. 3 is a perspective view of an end portion side of a tension roller which applies a tensile force to an intermediate transfer belt according to the first exemplary embodiment.
Figure 4:
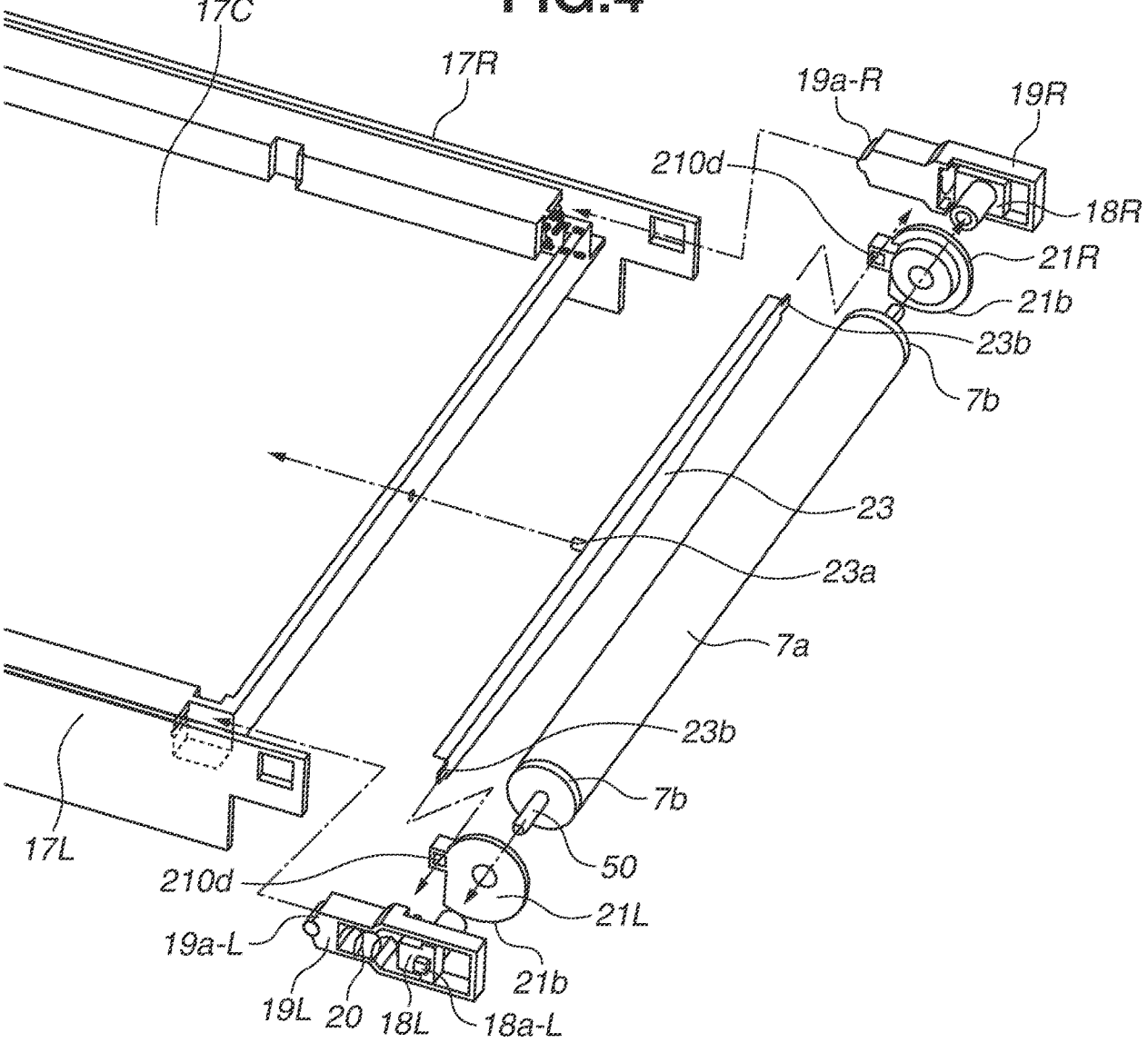
FIG. 4 is an exploded perspective view illustrating constituent components of a belt shift adjustment mechanism according to the first exemplary embodiment.

A configuration for applying a tensile force to the intermediate transfer belt 5 will be described with reference to FIGS. 3 and 4. FIG. 3 is a perspective view of an end portion side of the tension roller 7 which applies a tensile force to the intermediate transfer belt 5. FIG. 4 is an exploded perspective view illustrating constituent components of the belt shift adjustment mechanism.

As illustrated in FIG. 3, a tension roller bearing 18L (18R) slidably engages with a tension roller bearing holder 19L (19R) in a direction of the arrow A. A first urging member (a tension spring 20) is provided between the tension roller bearing 18L (18R) and the tension roller bearing holder 19L (19R). The tension roller bearing 18L (18R) urges the tension roller 7 via a rotating shaft 50 of the tension roller 7 so as to apply the tensile force to the intermediate transfer belt 5 by the aid of the tension spring 20.

As illustrated in FIG. 4, the tension roller 7 includes the rotating shaft 50, and a sleeve 7*a* and a flange 7*b*, serving as rotation unit, which support an inner circumferential surface of the intermediate transfer belt 5 and rotate with a movement of the intermediate transfer belt 5, and is integrally rotated. The rotating shaft 50 of the tension roller 7 is rotatably supported at the both ends by the tension roller bearings 18L and 18R serving as bearing support members.

[Belt Shift Adjustment Mechanism]

Next, the belt shift adjustment mechanism will be described which functions in a case where the intermediate transfer belt 5 shifts to one end side in a belt width direction that is orthogonal to the direction in which the belt moves. The belt shift adjustment mechanism according to the present exemplary embodiment includes at least the tension roller 7, serving as a shift adjustment stretching member, and the adjustment members 21L and 21R, serving as a first adjustment member and a second adjustment member. The configurations of the adjustment members 21L and 21R are the same, so that the adjustment member that is brought into contact with the intermediate transfer belt 5 when the intermediate transfer belt 5 is shifted is defined as the first adjustment member, and the other one is defined as the second adjustment member.

The adjustment members 21L and 21R can be moved by coming into contact with the belt 5 and receiving a force therefrom, and are arranged on the both end sides of the tension roller 7 as illustrated in FIG. 4. Specifically, the adjustment members 21L and 21R have a cam shape, and come into contact with the intermediate transfer belt 5 in a case where the belt 5 is shifted in the belt width direction, and thus rotate in the same direction as the movement direction of the belt 5. Cam curved surfaces 21*b* of the adjustment members 21L and 21R come into contact with a sliding surface 22 formed on the main body frame member 60 (refer to FIG. 1). The adjustment members 21L and 21R are respectively supported by and rotatably engaged with the tension roller bearings 18L and 18R. Thus, the axis of the rotation of the respective adjustment members 21L and 21R is coaxial with the axis of the rotation of the tension roller 7.

Figure 5:
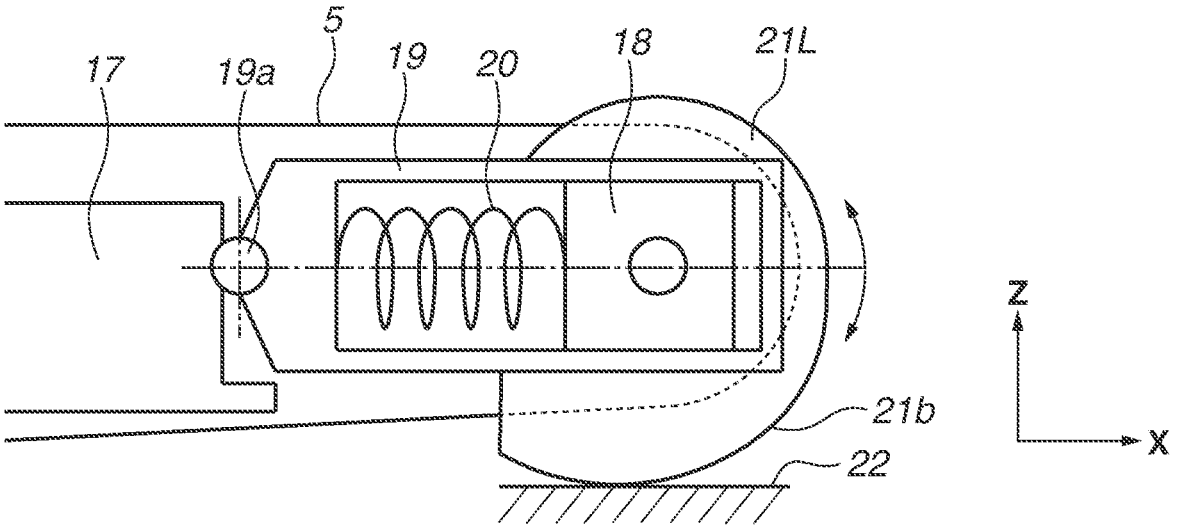
FIG. 5 is a partial side view of the belt shift adjustment mechanism according to the first exemplary embodiment.

FIG. 5 is a partial side view on an L side (another end side in the belt width direction) of the belt shift adjustment mechanism. A relationship of each member on an R side (the one end side in the belt width direction) is the same as that in FIG. 5, and thus a description thereof is omitted.

As illustrated in FIG. 5, the positions of the tension roller bearing 18, the rotating shaft 5 of the tension roller 7, and the tension roller 7 (not illustrated) in the Z direction (hereinbelow, the Z direction is referred to as a height direction) are determined by the sliding surface 22 and the adjustment members 21L and 21R.

The tension roller bearing holder 19(L) is held so as to be swingable by a predetermined angle with respect to the frame member 17(L) centering on a bearing holder fulcrum 19*a*. The bearing holder fulcrum 19*a* is a swing shaft of the shift adjustment stretching member. In other words, the tension roller bearing holder 19(L) can follow the height of the tension roller 7 defined by the adjustment member 21L in a state of holding the tension spring 20.

Figure 6A:
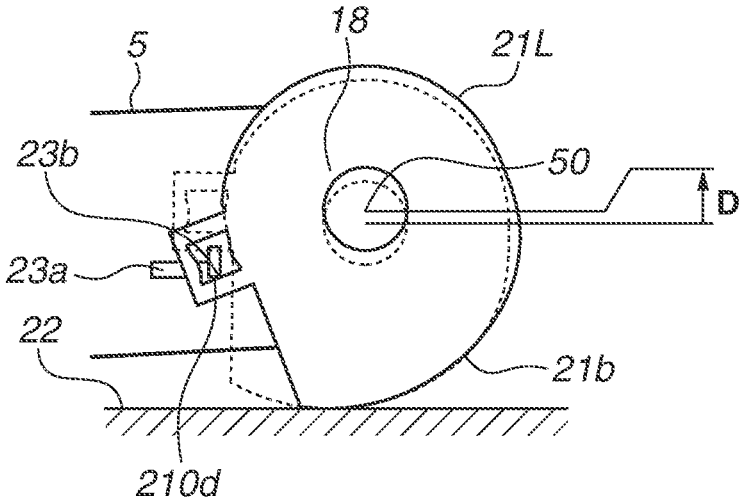
FIGS. 6A to 6C illustrate operations of an adjustment member in the belt shift adjustment mechanism according to the first exemplary embodiment.
Figure 6B:
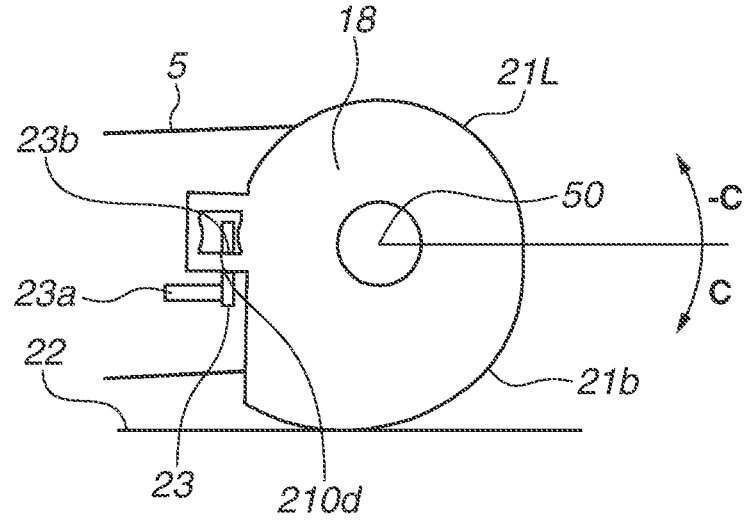
Figure 6C:
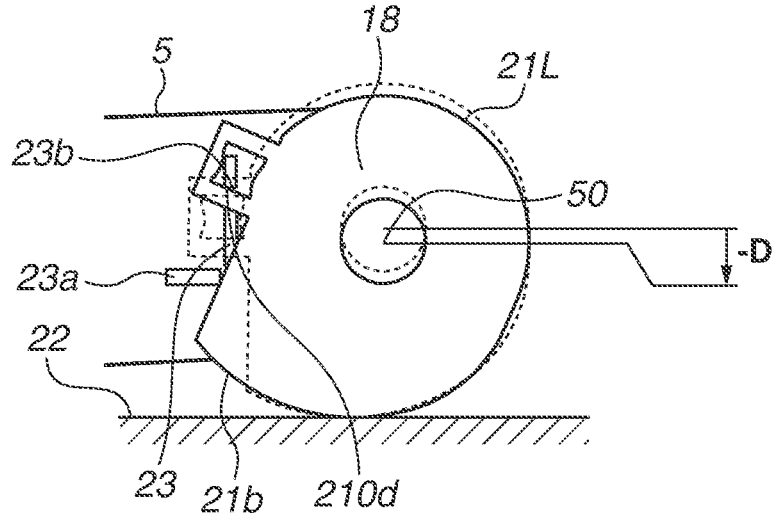

FIGS. 6A to 6C each illustrate a relationship between an operation of the adjustment member 21L and an operation of the tension roller 7. As described above, the cam curved surface 21*b* formed on a part of the adjustment member 21L is in contact with the sliding surface 22, which is a fixing surface. Further, the cam shape is configured such that the height of the tension roller bearing 18L continuously changes depending on a rotation phase of the adjustment member 21L. More specifically, in a case where the adjustment member 21L rotates in a conveyance direction (the C direction) of the intermediate transfer belt 5 in FIG. 6B, the adjustment member 21L operates to lower the tension roller bearing 18L (a status in FIG. 6C). In a case where the adjustment member 21L rotates in the opposite direction to a belt movement direction (the −C direction), the adjustment member 21L operates to lift the tension roller bearing 18L (a state in FIG. 6A).

Figure 7:
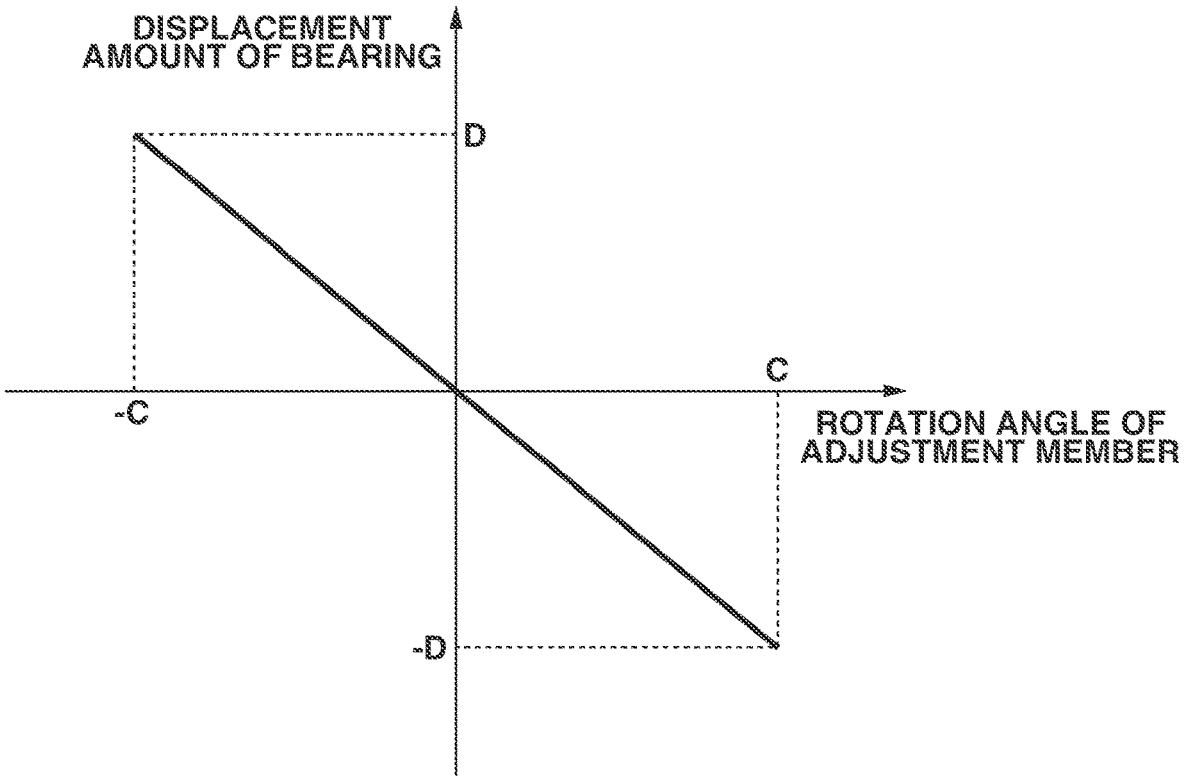
FIG. 7 illustrates a rotation angle of the adjustment member and a displacement amount of a bearing according to the first exemplary embodiment.

FIG. 7 illustrates a rotation angle of the adjustment member and a displacement amount (a swinging amount) D of the bearing. A relationship between the rotation angle of the adjustment members 21L and 21R and the displacement amount D of the tension roller bearings 18L and 18R is roughly illustrated in FIG. 7. The rotating shaft 50 of the tension roller 7 supported by the tension roller bearings 18L and 18R and the tension roller 7 are displaced by following the tension roller bearings 18L and 18R.

In a case where the intermediate transfer belt 5 is shifted in the belt width direction and one of the adjustment members 21L and 21R rotates in the rotation direction of the intermediate transfer belt 5, the other is linked to the rotation and is rotated in the opposite direction.

In the present exemplary embodiment, the adjustment members 21L and 21R are coupled by a coupling member (a link member 23) provided as a link unit as illustrated in FIG. 4. A link member fulcrum shaft 23*a* of the link member 23 is arranged in a central area in the width direction of the intermediate transfer belt 5, and the link member 23 is swingably supported by a frame member 17C. The link member 23 includes adjustment member engaging portions 23*b*-L and 23*b*-R, and the adjustment member engaging portions 23*b*-L and 23*b*-R engage with a link member engaging portion 210*d* of the respective adjustment members 21L and 21R. The link member engaging portions 210*d* of the adjustment members 21L and 21R are arranged on an upstream side of the rotating shaft 50 of the tension roller 7 in the belt movement direction. In a case where one of the adjustment members 21L and 21R is rotated in a certain direction (the C direction) by the link member 23, the other is rotated in the opposite direction (the −C direction) by approximately the same angle via the link member 23.

[Outline of Belt Shift Adjustment Operation]

Figure 8A:
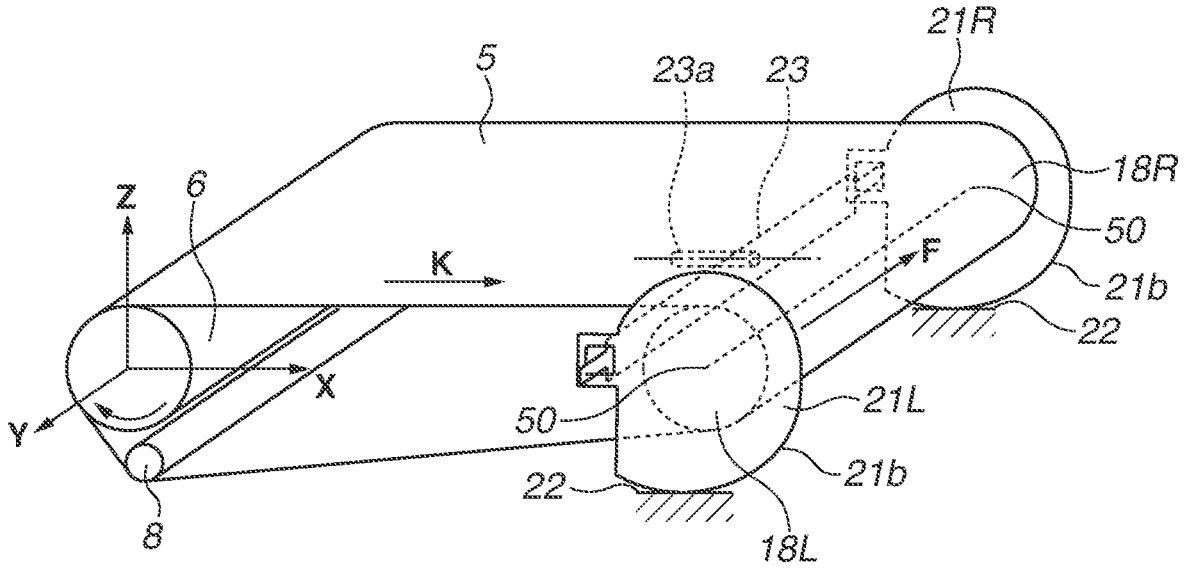
FIGS. 8A and 8B illustrate operations of the belt shift adjustment mechanism according to the first exemplary embodiment.
Figure 8B:
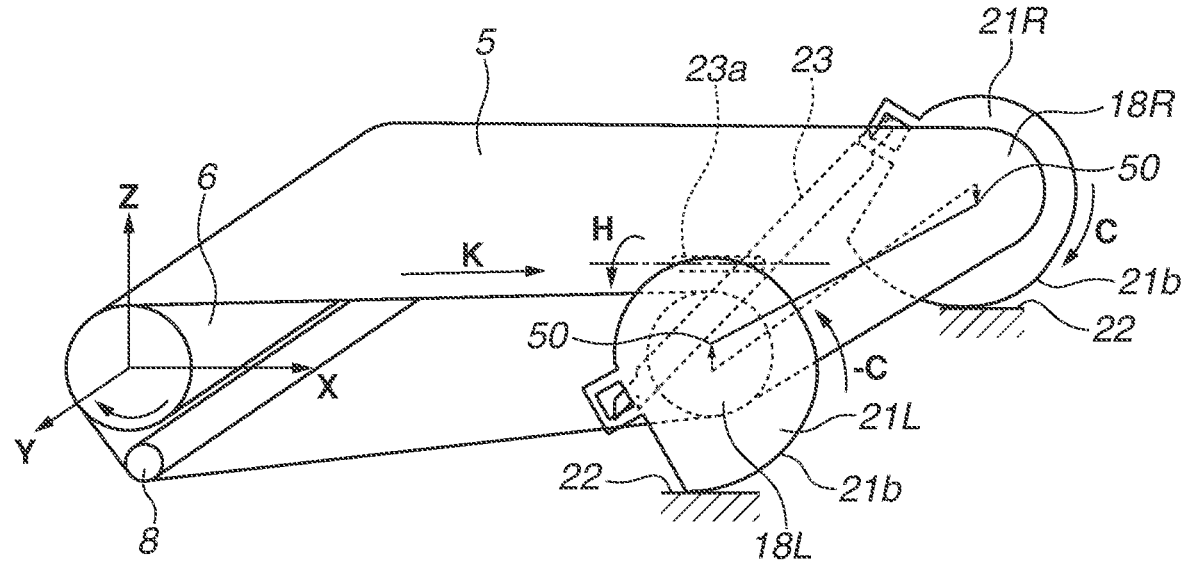
Figure 11A:
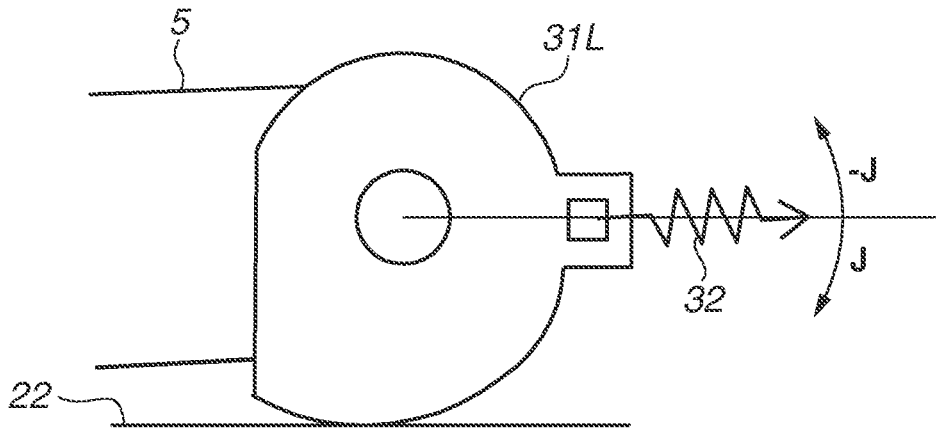
FIGS. 11A and 11B are schematic diagrams illustrating other embodiments of an adjustment mechanism.
Figure 11B:
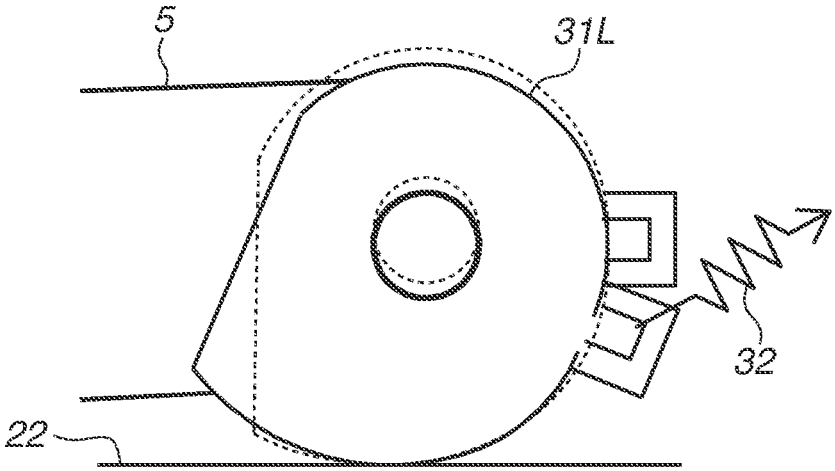
Figure 12A:
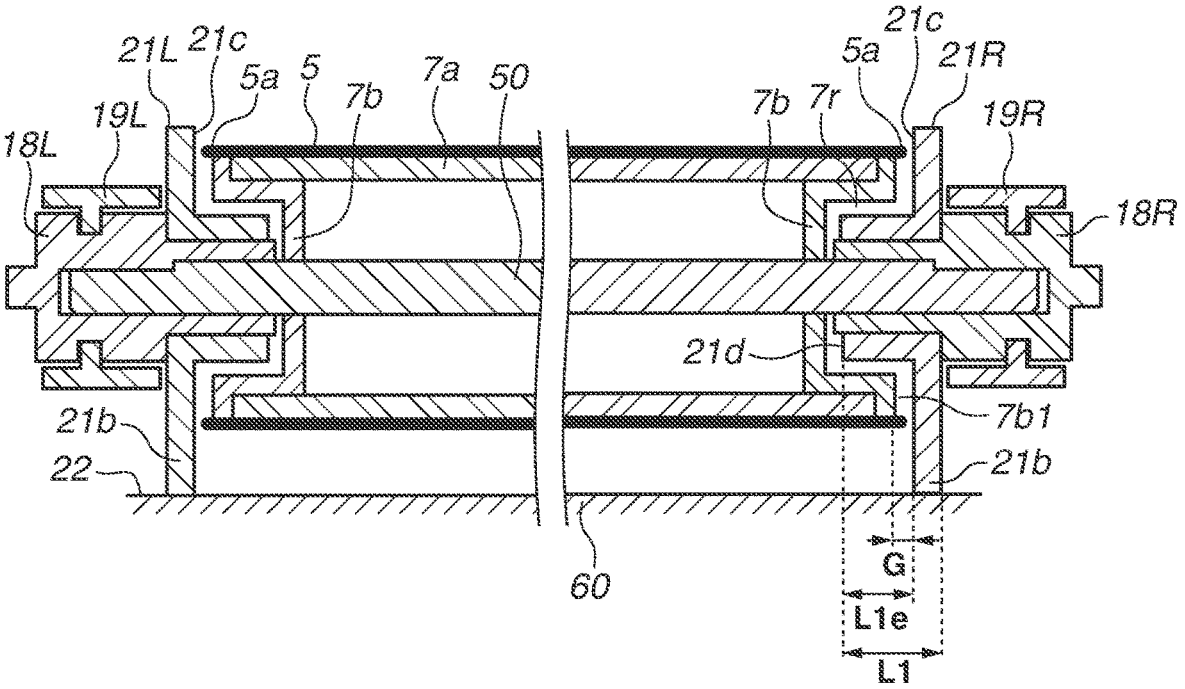
FIGS. 12A and 12B are schematic sectional views illustrating configurations and operations of the adjustment member according to the first exemplary embodiment.
Figure 12B:
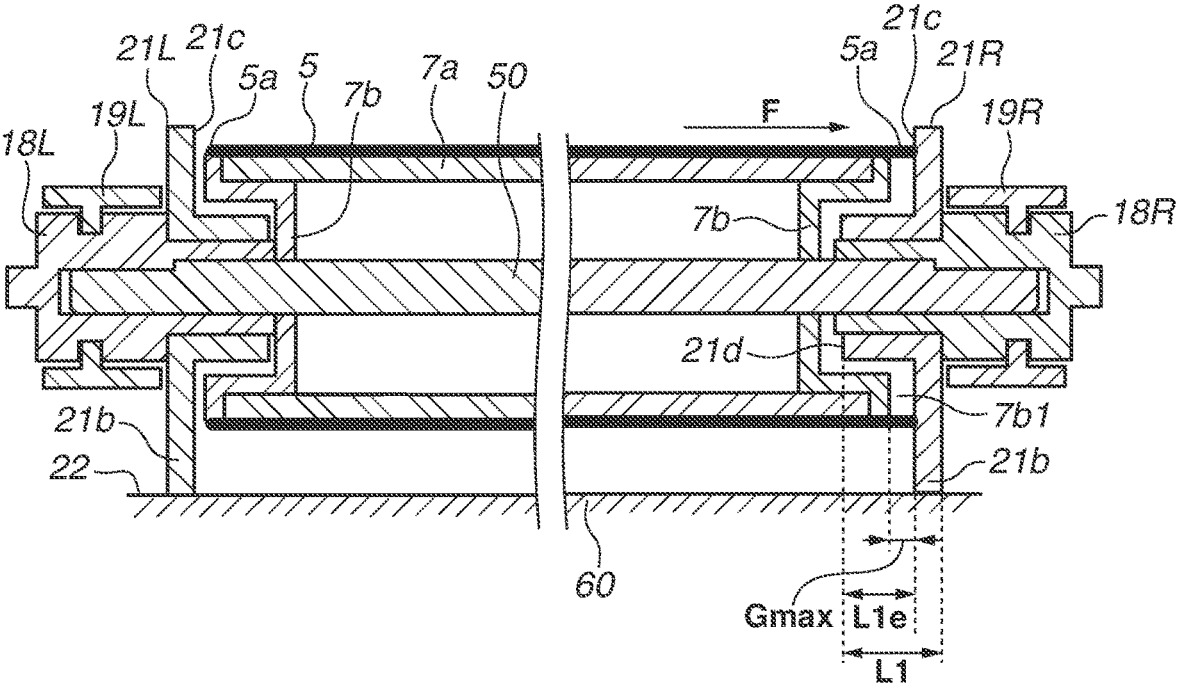

A shift adjustment operation performed by the belt conveyance apparatus according to the present exemplary embodiment will be described with reference to FIGS. 8A to 12B. FIGS. 8A and 8B each illustrate an operation performed by the belt shift adjustment mechanism. FIGS. 12A and 12B are sectional views of the belt shift adjustment mechanism viewed from the direction of the arrow A in FIG. 3.

As illustrated in FIG. 8A, the intermediate transfer belt 5 is conveyed in the K direction by the driving roller 6. Here, a description will be provided of an adjustment operation in a case where the intermediate transfer belt 5 is shifted in the F direction.

As illustrated in FIG. 12B, in a case where the intermediate transfer belt 5 is shifted in the direction of the arrow F, a belt end portion 5*a* is brought into contact with a belt sliding surface 21*c* (right side in the figure) of the adjustment member 21R, and the shift of the intermediate transfer belt 5 in the F direction is adjusted. The shift of the belt 5 is adjusted, and thus a contact pressure occurs between the belt end portion 5*a* and the belt sliding surface 21*c*. This contact pressure is referred to as a shifting force. In a case where the image forming apparatus is not provided with the belt shift adjustment mechanism, a load on the belt end portion increases as the shifting force increases, which may lead to breakage of the intermediate transfer belt 5.

In the belt conveyance apparatus, in a case where the belt end portion 5*a* comes into contact with the belt sliding surface 21*c* of the adjustment member 21R, the belt end portion 5*a* rotates the adjustment member 21R by a frictional force derived from the shifting force in the rotation direction (the direction of the arrow C) of the intermediate transfer belt 5 as illustrated in FIG. 8B. With the rotation of the adjustment member 21R in the C direction, an end portion of the tension roller 7 on the side (the R side) to which the intermediate transfer belt 5 is shifted is lowered. At the same time, the adjustment member 21R swings the coupled link member 23 around the link member fulcrum shaft 23*a*. Further, the link member 23 rotates the adjustment member 21L on the opposite side in the opposite direction (the −C direction) to the belt movement direction. With the rotation of the adjustment member 21L, the end portion of the tension roller 7 on the opposite side (the L side) to the side to which the intermediate transfer belt 5 is shifted moves upward.

The tension roller 7 is tilted with respect to the driving roller 6 by the above-described operation. Both end portions of the tension roller 7 are displaced by the link member 23 by an approximately same amount in the opposite direction. In other words, the tension roller 7 is in a state of being tilted symmetrically with respect to the link member fulcrum shaft 23*a* in the belt width direction.

The belt conveyance apparatus according to the present exemplary embodiment is configured to move the intermediate transfer belt 5 in the direction opposite to an initial shift direction (the F direction) by the tilt of the tension roller 7, so that the shift of the intermediate transfer belt 5 is adjusted and the shifting force is reduced. When the shifting force of the intermediate transfer belt 5 becomes sufficiently small, the belt end portion 5*a* loses a force to rotate the adjustment member 21R, and the adjustment member 21R stops rotating. At the same time that the adjustment member 21R stops rotating, the adjustment member 21L also stops rotating. The adjustment members 21R and 21L maintain their positions (phases) after stopping rotation.

As described above, the belt shift adjustment mechanism according to the present exemplary embodiment has the configuration in which the adjustment members 21L and 21R are linked and moved in the opposite directions to tilt the tension roller 7 in a case where the belt 5 is shifted, so that the tension roller 7 is tilted easier than in a configuration in which only one adjustment member is used for tilting.

Figure 9:
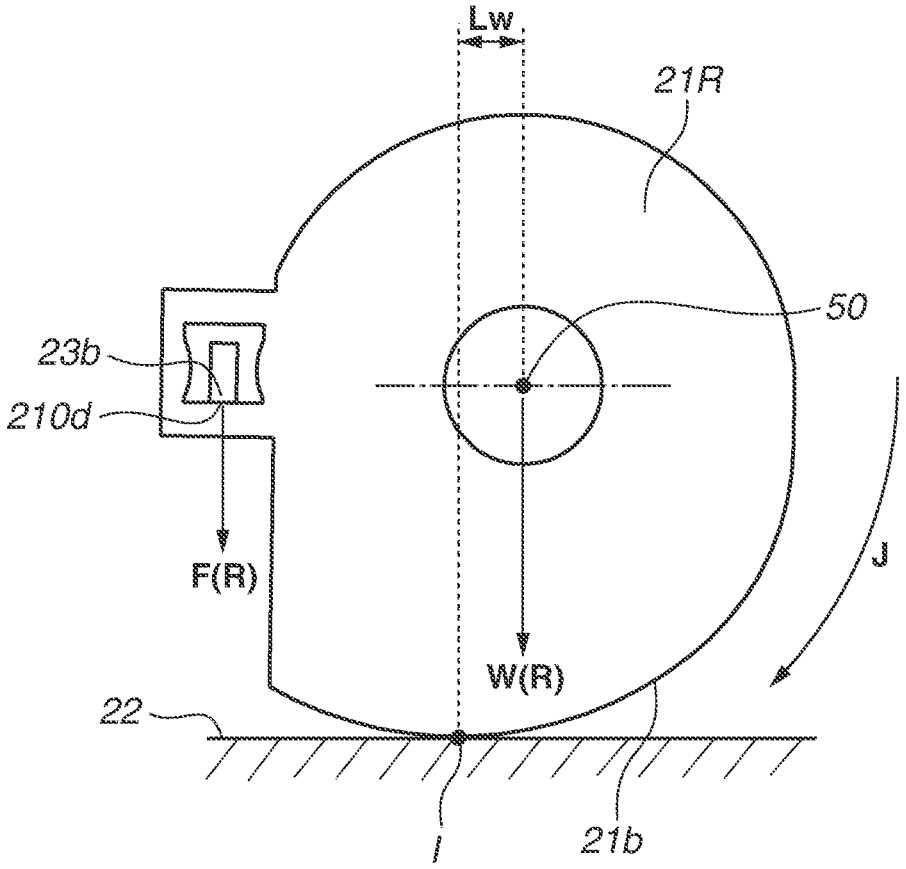
FIG. 9 illustrates an operation of the belt shift adjustment mechanism according to the first exemplary embodiment.

FIG. 9 illustrates a force acting on the adjustment member 21R which is not connected to the link member 23. A point I indicates a contact point between the adjustment member 21R and the sliding surface 22, and a distance Lw indicates a distance between an axis (the center of the rotating shaft 50) and the point I in the horizontal direction. The axis 21*a* is the center of rotation of the adjustment member 21R.

The adjustment member 21R is in contact with the sliding surface 22 at the point I, and an own weight W(R) of the tension roller 7 acts on a position of the axis 21*a*, which is shifted by the distance Lw from the point I. Thus, a force to rotate in the J direction acts on the adjustment member 21R. A similar configuration can be applied to the adjustment member 21L on the opposite side. In other words, the adjustment members 21R and 21L both rotate in the J direction in a state in which they can freely rotate, and the tension roller bearings 18R and 18L both rotate as illustrated in FIG. 6C only by the own weight. Thus, in order to rotate the positions of the tension roller bearings 18R and 18L in the −J direction, an urging force of an urging member, such as a spring, which pulls the tension roller bearings 18R and 18L is required.

Figure 10:
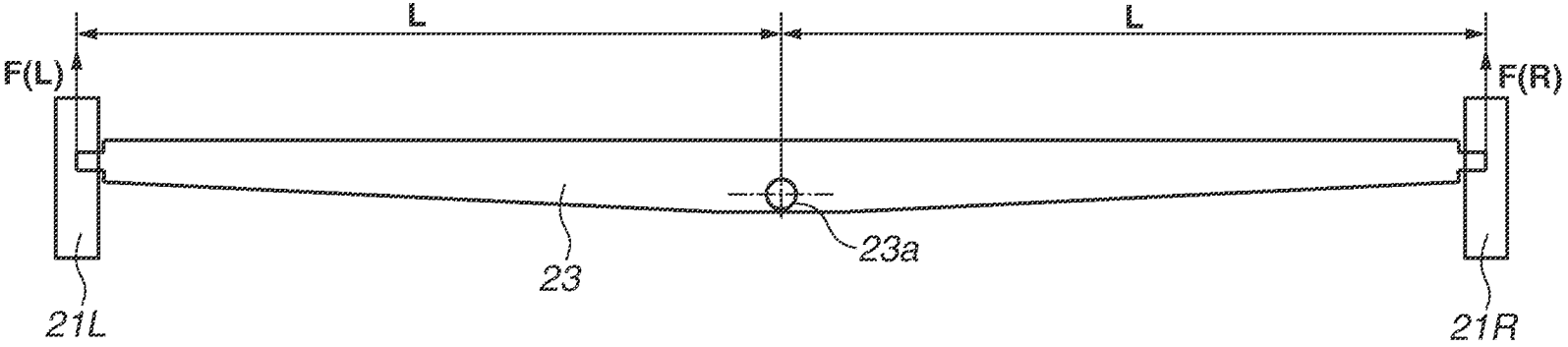
FIG. 10 illustrates a force acting on the adjustment member which is not connected to a link member.

However, according to the present exemplary embodiment, an urging unit, such as a tension spring, is not provided. As illustrated in FIG. 10, the adjustment members 21L and 21R are arranged at positions substantially symmetrical with respect to the link member fulcrum shaft 23*a* as the center. The own weight of the tension roller 7 approximately equally acts on each of the adjustment members 21L and 21R, and rotation moment is also approximately equal to each other. This means that, in a state in which the shifting force does not occur on the intermediate transfer belt 5, the rotation moments applied to the adjustment members 21L and 21R on the both ends are balanced via the link member 23, and the adjustment members 21L and 21R can maintain a static state. In other words, in the present exemplary embodiment, the tilt of the tension roller 7 can be independently maintained without resource to a force received from the intermediate transfer belt 5 or a force of the urging unit, such as the tension spring.

Further, a rotation amount of one adjustment member and a reverse rotation amount of the other adjustment member are approximately equal to each other by the link member 23, and thus the state in which the rotation moments of the adjustment members 21L and 21R are balanced can be maintained.

According to the present exemplary embodiment, it is not necessary to rotate the adjustment members 21L and 21R against the urging force of the urging member, so that the adjustment members 21L and 21R can be rotated with a small load.

According to the present exemplary embodiment, the configuration has been described above which uses the link member without providing the urging unit, such as the tension spring, but an effect produced by the configuration, which is a characterizing feature of the present exemplary embodiment described below, is not limited to that produced by this configuration. For example, as illustrated in FIGS. 11A and 11B, a configuration may be adopted in which an adjustment member 31L (a not-illustrated adjustment member on the R side has the same configuration) is urged by an urging unit such as a tension spring 32 and is constantly applied with a force to return to an initial position. In such a configuration, if the adjustment member 31L rotates in the J direction by the shifting force of the intermediate transfer belt 5 as illustrated in FIG. 11B, the tension spring 32 applies a force acting in the −J direction to return to the initial position illustrated in FIG. 11A to the adjustment member 31L, so that the shift can be adjusted.

[Support Configuration of Adjustment Member]

Figure 13A:
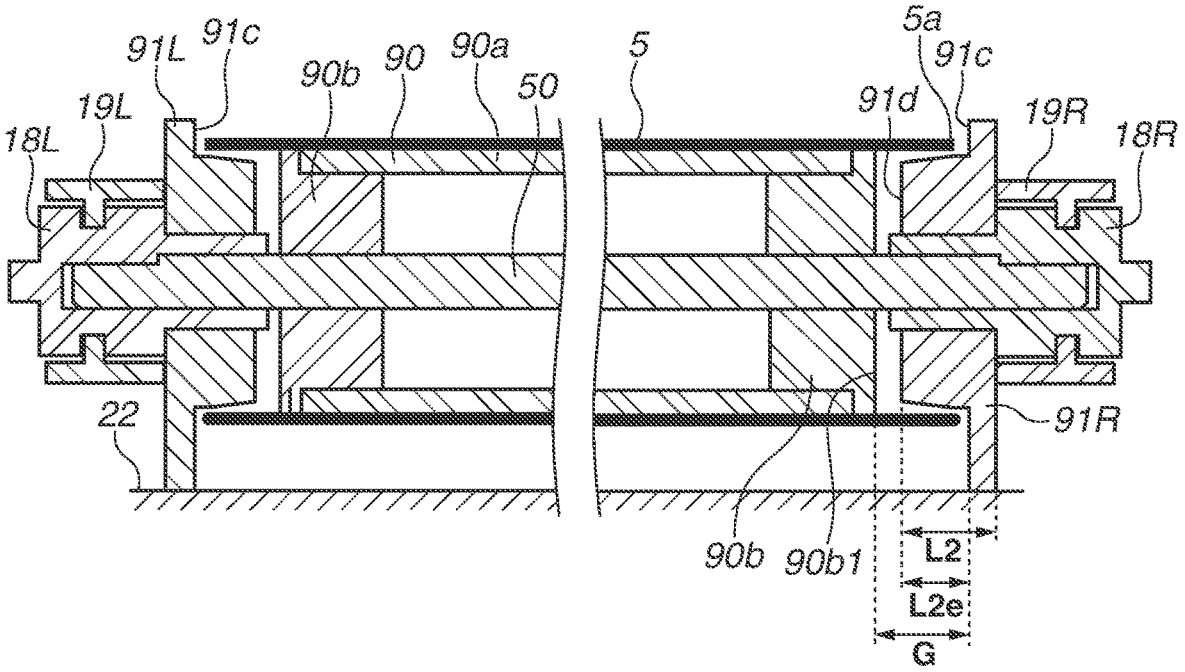
FIGS. 13A and 13B are schematic sectional views of an adjustment member according to a conventional configuration.
Figure 13B:
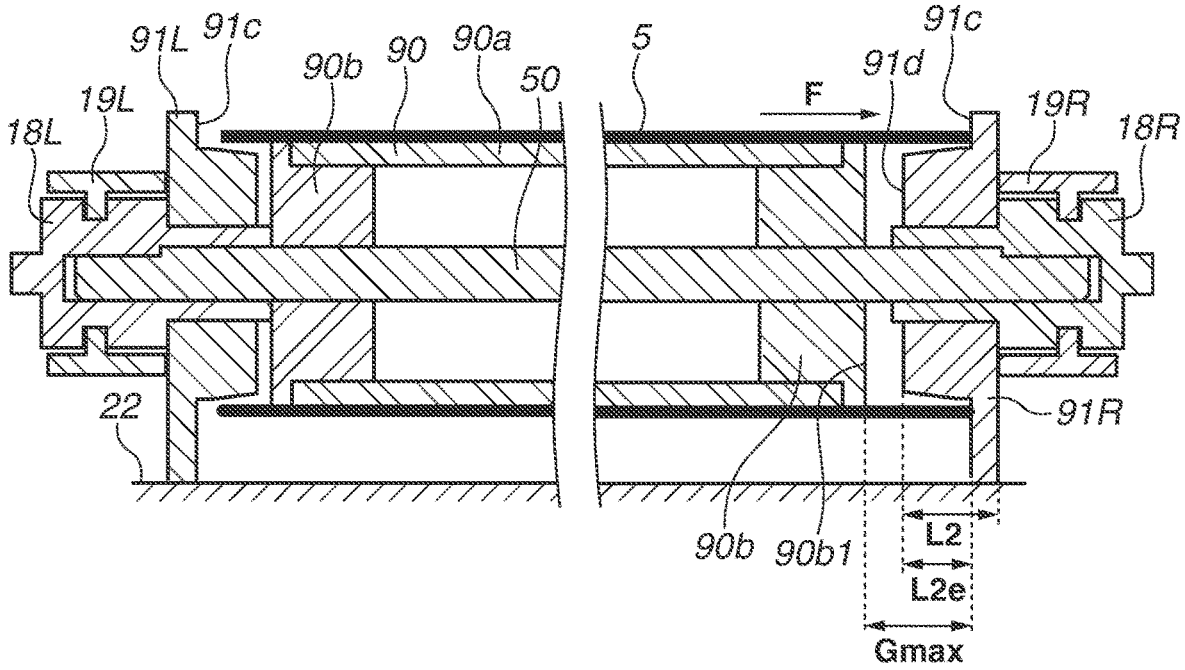

FIG. 12A is a schematic diagram illustrating a peripheral configuration of the adjustment members 21L and 21R in a state in which the intermediate transfer belt 5 is not shifted. FIG. 12B is a schematic diagram illustrating the peripheral configuration of the adjustment members 21L and 21R in a state in which the intermediate transfer belt 5 is shifted. FIG. 13A is a schematic diagram illustrating a peripheral configuration of adjustment members 91L and 91R in a state in which the intermediate transfer belt 5 is not shifted in a conventional configuration. FIG. 13B is a schematic diagram illustrating the peripheral configuration of the adjustment members 91L and 91R in a state in which the intermediate transfer belt 5 is shifted in the conventional configuration. In the following description, regarding various members on the both end sides in the belt width direction, only the configuration on the R side, which is one end side, will be described if the configuration and operation on the both end sides do not need to be particularly distinguished, and a description of the configuration on the L side, which is the other end side, will be omitted.

As illustrated in FIGS. 12A and 12B, the tension roller 7 includes the sleeve 7*a*, the flange 7*b*, and the rotating shaft 50. The both ends in the belt width direction of the rotating shaft 50 are rotatably supported by the tension roller bearings 18L and 18R, which are the bearing support members. The rotating shaft 50, the sleeve 7*a*, and the flange 7*b* integrally rotate with the rotation of the intermediate transfer belt 5. The tension roller 7 according to the present exemplary embodiment includes the sleeve 7*a* and the flange 7*b* as separate members. However, the sleeve and the flange may be integrally configured without being limited to this configuration. All of the sleeve 7*a*, the flange 7*b*, and the rotating shaft 50 may be integrally configured.

As described above, the belt end portion 5*a* comes into contact with the belt sliding surface 21*c* of the adjustment member 21R, and thus the adjustment member 21R provided on the outside of the tension roller 7 in the belt width direction rotates by receiving the frictional force derived from the shifting force from the belt end portion 5*a*. At that time, if the adjustment member 21R is tilted outward in the belt width direction with respect to the tension roller bearing 18R by the shifting force, the rotation for shift adjustment by the adjustment member 21R is hindered. Thus, in the present exemplary embodiment, the adjustment member 21R is rotatably supported with respect to an outer circumferential surface of the tension roller bearing 18R and has a certain support length L1 as a length supported by the tension roller bearing 18R (a similar configuration applies to the adjustment member 21L).

The flange 7*b* includes a recessed portion 7*r* which is recessed inward in the belt width direction, and the recessed portion 7*r* includes therein a part of the tension roller bearing 18R and a part of the adjustment member 21R. An outer end surface 7*b*1 (a first end portion) of the flange 7*b* in the belt width direction is the end surface that is provided at a position closest to the belt end portion 5*a*, at a position closest to the belt sliding surface 21*c*, and faces the adjustment member 21R. An inner end surface 21*d* (a second end portion) of the adjustment member 21R in the belt width direction is an end surface which is included in the recessed portion 7*r* and is provided at a position farthest from the belt sliding surface 21*c* of the adjustment member 21R. In the configuration according to the present exemplary embodiment, the inner end surface 21*d* of the adjustment member 21R is provided on an inside of the outer end surface 7b1 in the belt width direction, in other words, on a side toward the center of the tension roller 7 of the outer end surface 7b1.

In the present exemplary embodiment, the part of the adjustment member 21R is included in the recessed portion 7r, so that a gap G between the outer end surface 7b1 of the flange 7b and the belt sliding surface 21c can be reduced while the support length L1 of the adjustment member 21R is secured for a certain distance.

As illustrated in FIG. 12B, in a case where the intermediate transfer belt 5 is shifted in the direction of the arrow F in FIG. 12B by the shifting force, a reaction force is applied to the tension roller 7, and each component is shifted to the opposite side to the direction of the arrow F in FIG. 12B within a range of backlash provided in the component. Accordingly, the surface of the recessed portion 7r of the flange 7b comes into contact with an end portion of the tension roller bearing 18L on the adjustment member 21L side. In a case where the tension roller 7 is shifted to the opposite side to the direction of the arrow F in FIG. 12B, if a part of the flange 7b comes into contact with the adjustment member 21L, it becomes a factor that contributes to hinder the rotation for shift adjustment. Thus, in the present exemplary embodiment, the flange 7b is configured to be brought into contact with the tension roller bearing 18L so as not to come into contact with the adjustment member 21L in a case where the tension roller 7 is shifted.

In a state in which the flange 7b on the adjustment member 21L side is in contact with the tension roller bearing 18L, a gap Gmax appears between the outer end surface 7b1 and the belt sliding surface 21c on the adjustment member 21R side. The gap Gmax is the largest gap that can appear between the outer end surface 7b1 and the belt sliding surface 21c with the rotation of the intermediate transfer belt 5. In the present exemplary embodiment, as illustrated in FIG. 12B, a length of the gap Gmax in the belt width direction is shorter than a distance L1e from the inner end surface 21d to the belt sliding surface 21c of the adjustment member 21R. In order to prevent buckling of the end portion of the intermediate transfer belt 5, it is desirable that the gap Gmax is as narrow as possible, and in the present exemplary embodiment, the gap Gmax is 1.5 mm, which will be described in detail below.

Next, the conventional configuration will be described with reference to FIGS. 13A and 13B. As illustrated in FIGS. 13A and 13B, a tension roller 90 according to the conventional configuration includes a sleeve 90a, a flange 90b, and the rotating shaft 50 of the tension roller 90, and these members integrally rotate with the rotation of the intermediate transfer belt 5. The conventional configuration includes the adjustment members 91L and 91R which have a function similar to that of the adjustment members 21L and 21R according to the present exemplary embodiment. In the following description, the adjustment members 91L and 91R and the flange 90b according to the conventional configuration will be mainly described which are different from those of the present exemplary embodiment. Other members and operations are denoted by the same reference numerals as those of the present exemplary embodiment, and descriptions thereof are omitted.

In the conventional configuration, as illustrated in FIG. 13A, an outer end surface 90b1 of the flange 90b in the belt width direction is the end surface that is provided at a position closest to the belt end portion 5a and faces the adjustment member 91R. An inner end surface 91d of the adjustment member 91R in the belt width direction is an end surface which faces the outer end surface 90b1 of the flange 90b and is provided at a position farthest from a belt sliding surface 91c of the adjustment member 91R. In the conventional configuration, the adjustment member 91R is provided on an outside of the outer end surface 90b1 in the belt width direction, in other words, on the tension roller bearing 18R side of the outer end surface 90b1. In the conventional configuration, also in order to prevent the adjustment member 91R from being tilted with respect to the tension roller bearing 18R to an outside in the belt width direction by a shifting force, the adjustment member 91R is provided with a support length L2 having a certain length with respect to the tension roller bearing 18R.

As described above, in the conventional configuration, the adjustment member 91R having the support length L2 is provided on the outside of the flange 90b in the belt width direction, and thus, the gap G is longer than a distance from the inner end surface 91d to the belt sliding surface 91c. The gap G in the conventional configuration is defined in a manner similar to the present exemplary embodiment, and, specifically, refers to a gap from the outer end surface 90b1 to the belt sliding surface 91c of the adjustment member 91R in the belt width direction. As illustrated in FIG. 13A, in the conventional configuration, the adjustment member 91R is supported by the tension roller bearing 18R on the outside of the flange 90b in the belt width direction, so that the gap G in the conventional configuration is longer than the gap G described in the configuration of the present exemplary embodiment.

As illustrated in FIG. 13B, according to the conventional configuration, in a case where the intermediate transfer belt 5 is shifted in the direction of the arrow F in FIG. 13B by the shifting force, first, the tension roller 7 is shifted to the opposite side to the direction of the arrow F in FIG. 13B within a range of its backlash as in the present exemplary embodiment. Then, the outer end surface 90b1 of the flange 90b comes into contact with the end portion of the tension roller bearing 18L on a side of the adjustment member 91L. At this time, the gap Gmax appears between the outer end surface 90b1 and the belt sliding surface 91c on the adjustment member 91R side. The gap Gmax is the largest gap that can appear between the outer end surface 90b1 and the belt sliding surface 91c with the rotation of the intermediate transfer belt 5. In the conventional configuration, the length of the gap Gmax is longer than a distance L2e from the inner end surface 91d of the adjustment member 91R to the belt sliding surface 91c in the belt width direction as illustrated in FIG. 13B.

[Variation]

Figure 14A:
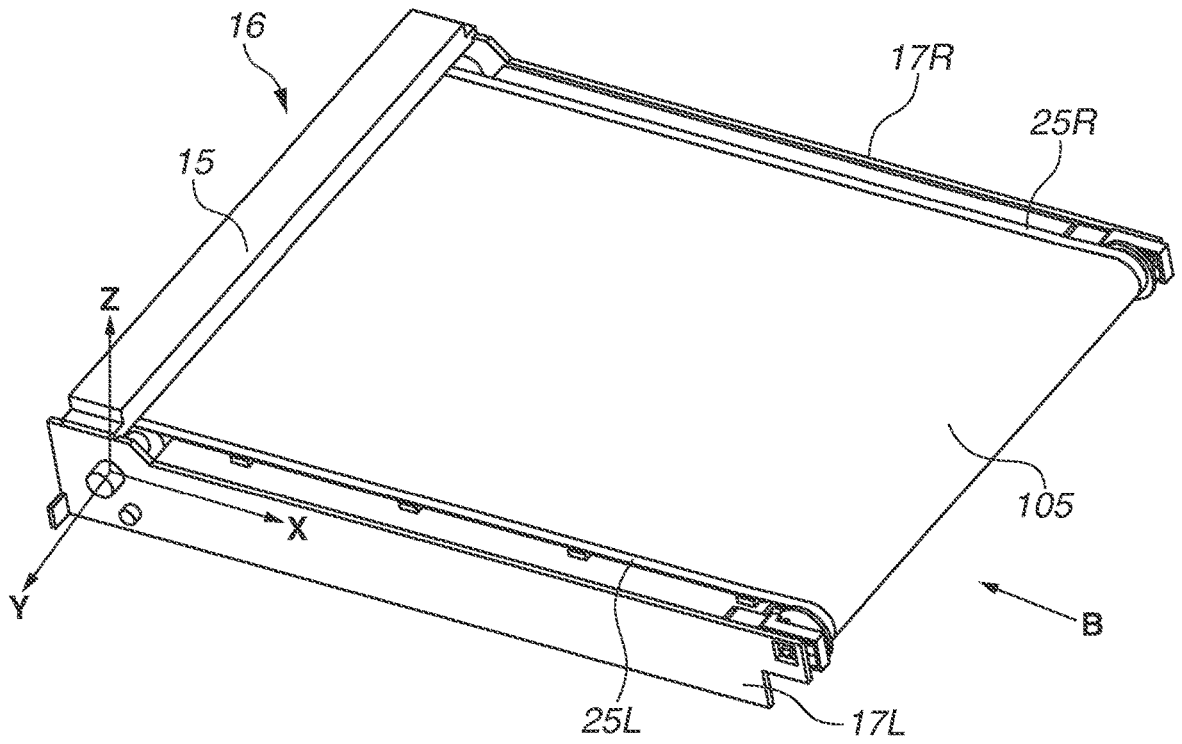
FIGS. 14A and 14B are schematic diagrams illustrating a configuration according to a variation of the first exemplary embodiment.
Figure 14B:
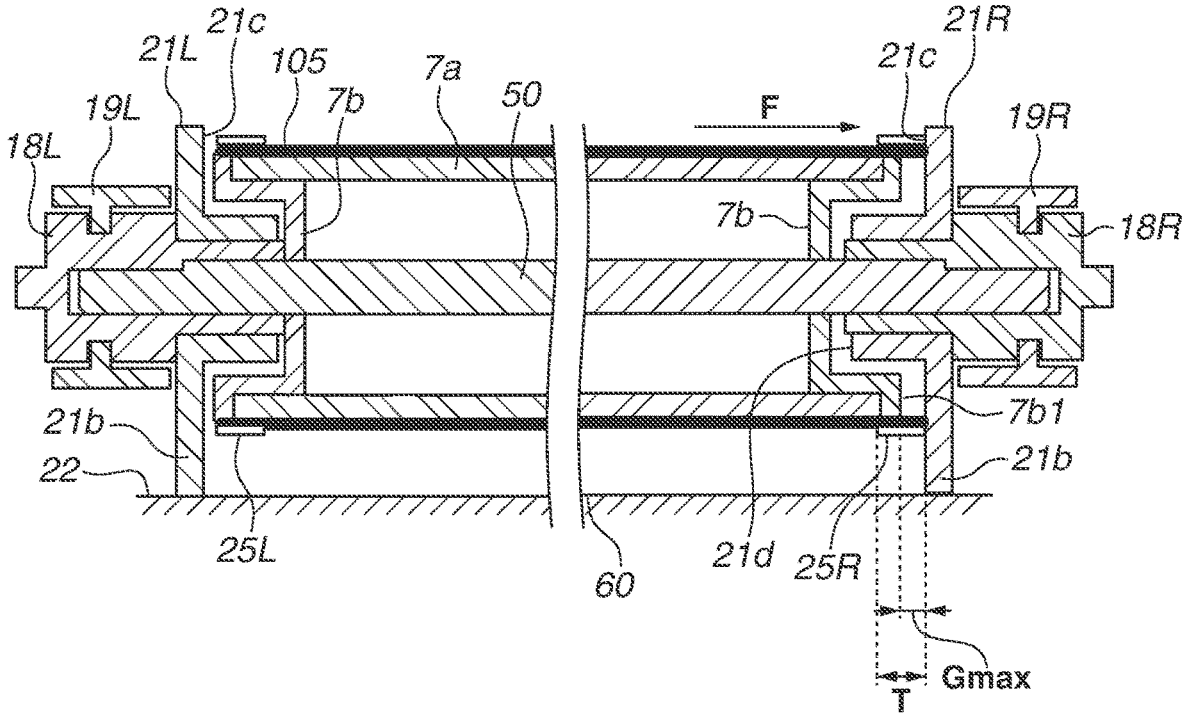

As a variation of the present exemplary embodiment, a reinforcing tape, which is a sheet-like protection member for protecting an end portion of an intermediate transfer belt 105 may be provided on the both end sides of the intermediate transfer belt 105 in the belt width direction. FIG. 14A is a schematic perspective view of the configuration of the intermediate transfer belt 105 in the variation. FIG. 14B is a schematic diagram illustrating a state in which the intermediate transfer belt 105 is shifted in the configuration of the variation. In the following description, the configurations and operations common to the present exemplary embodiment and the variation are denoted by the same reference numerals, and descriptions thereof are omitted.

In the variation, tapes 25R and 25L for reinforcement extending in a movement direction of the intermediate transfer belt 105 are provided on outer circumferential surface sides of both end portions of the intermediate transfer belt 105, as illustrated in FIG. 14A. A material of the tape is not particularly limited, but an adhesive tape based on a polyester base material is used according to the present variation.

As illustrated in FIG. 14B, the tapes 25R and 25L are arranged on the both end portions of the intermediate transfer belt 105 with a predetermined width T. There is a possibility that the intermediate transfer belt 105 is shifted to each of the both end portions, so that it is desirable that the width T of the tapes 25R and 25L is set larger than the gap Gmax, which appears between the flange 7*b* and the adjustment member 21R in a case where the intermediate transfer belt 105 is shifted. In the present variation, the gap Gmax is 1.5 mm, so that the width T is set to 3 mm. Thus, the reinforcing tapes having a predetermined width are provided on the both end portions of the intermediate transfer belt 105, thus increasing the strength of the intermediate transfer belt 105 as compared with a configuration without a tape, and buckling of the belt end portion can be further reduced or prevented at the time of a belt shift adjustment operation.

[Relationship Between Gap Gmax and Buckling of Belt End Portion]

Figure 15A:
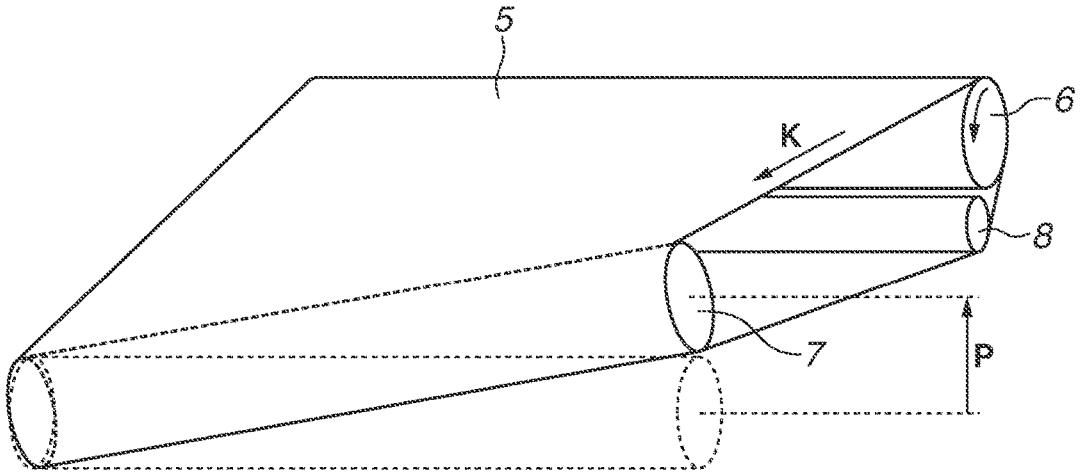
FIGS. 15A and 15B are respectively a schematic diagram and a graph illustrating a shifting force in a case where buckling of a belt end portion appears, according to the first exemplary embodiment.
Figure 15B:
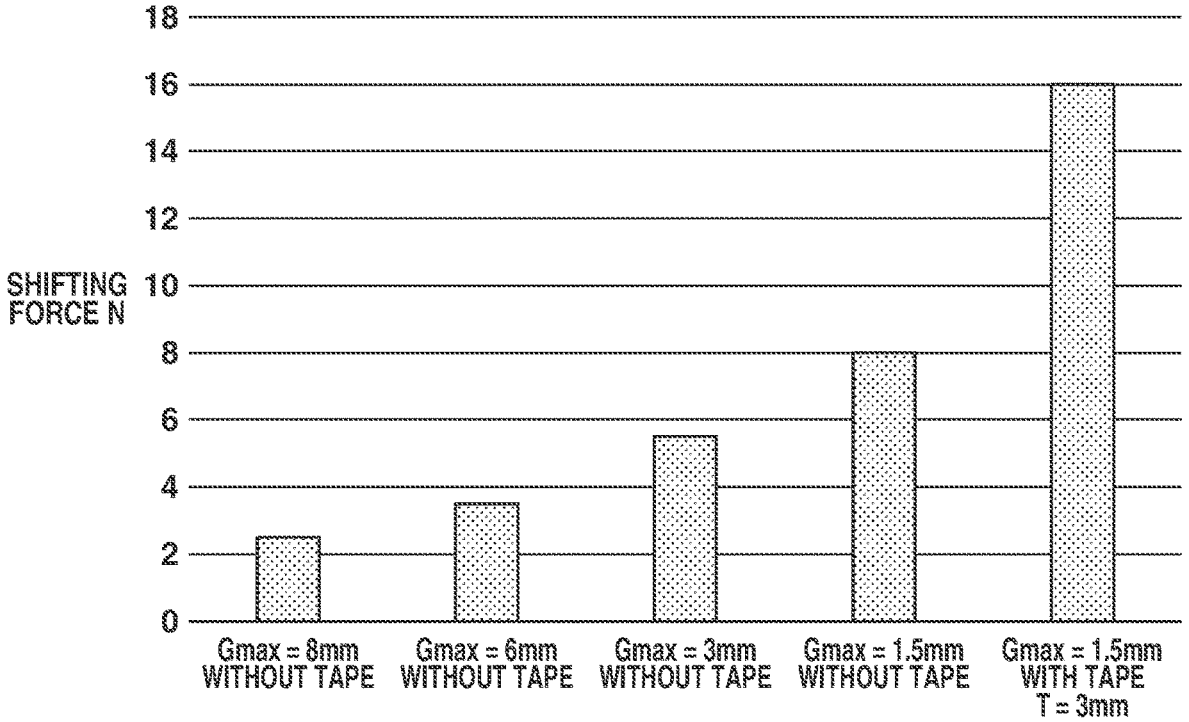

Next, a relationship between the gap Gmax, between the outer end surface of the flange and the belt sliding surface, and the shifting force at which the belt end portion buckles was evaluated by a measurement. FIG. 15A is a schematic diagram illustrating a twist amount of the intermediate transfer belt 5 in a case where the tension roller 7 is tilted by the adjustment member. FIG. 15B is a graph illustrating the shifting force at the time when buckling occurred at the belt end portion in this evaluation measurement.

As illustrated in FIG. 15A, in the present measurement, a height P of a roller end portion of the tension roller 7 when only one side of the tension roller 7 is tilted from the position represented by a dotted line is defined as a twist amount. The measurement of the shifting force on the intermediate transfer belt was conducted in such a manner that a force with which the intermediate transfer belt pushed the adjustment member when the intermediate transfer belt was shifted was measured with a load cell (type: LMA-A-20N M81, Kyowa Electronic Instruments Co., Ltd.).

In the measurement, a shift adjustment mechanism for removing the shift of the intermediate transfer belt was not operated, the twist amount P illustrated in FIG. 15A was increased to increase a load on the belt end portion, and the shifting force when the belt end portion of the intermediate transfer belt buckled was measured. As an evaluation, five configurations were prepared which include four configurations in each of which a value of the gap Gmax were set to a different one of 8 mm, 6 mm, 3 mm, and 1.5 mm, and a configuration in which the gap Gmax was set to 1.5 mm and a reinforcing tape having a width T of 3 mm was provided, and measurement and evaluation were performed on these configurations.

As illustrated in a graph of measurement results in FIG. 15B, we found that buckling occurred at the belt end portion with the shifting force of about 2.5 N in the configuration in which the gap Gmax is set to 8 mm, and the shifting force with which the buckling occurred at the belt end portion increases as the gap Gmax is narrowed. In the configuration according to the present exemplary embodiment in which the gap Gmax is set to 1.5 mm, the buckling of the belt end portion was not observed until the shifting force of about 8 N occurred. In the configuration according to the variation in which the tapes 25R and 25L for reinforcement having the width T of 3 mm were provided, the buckling of the belt end portion was not observed until the shifting force of about 16 N occurred.

This the evaluation revealed that buckling of the belt end portion can be reduced or prevented more as the value of the gap Gmax from the end portion of the flange of the tension roller which applies the stretching force to the intermediate transfer belt to the belt sliding surface decreases.

As described above, according to the present exemplary embodiment, the part of the adjustment member 21R is included in the recessed portion 7*r*, and thus, the lengths of the gap G and the gap Gmax are set to be shorter than the distance L1*e* from the inner end surface 21*d* to the belt sliding surface 21*c* of the adjustment member 21R. Accordingly, the present exemplary embodiment can reduce or prevent buckling of the belt end portion as compared with the conventional configuration by setting the gap G and the gap Gmax narrower than those in the conventional configuration while maintaining an operation performance of the adjustment member 21R by securing the support length L1 of the adjustment member 21R (a similar configuration applies to the adjustment member 21L) for a certain distance.

Figure 16:
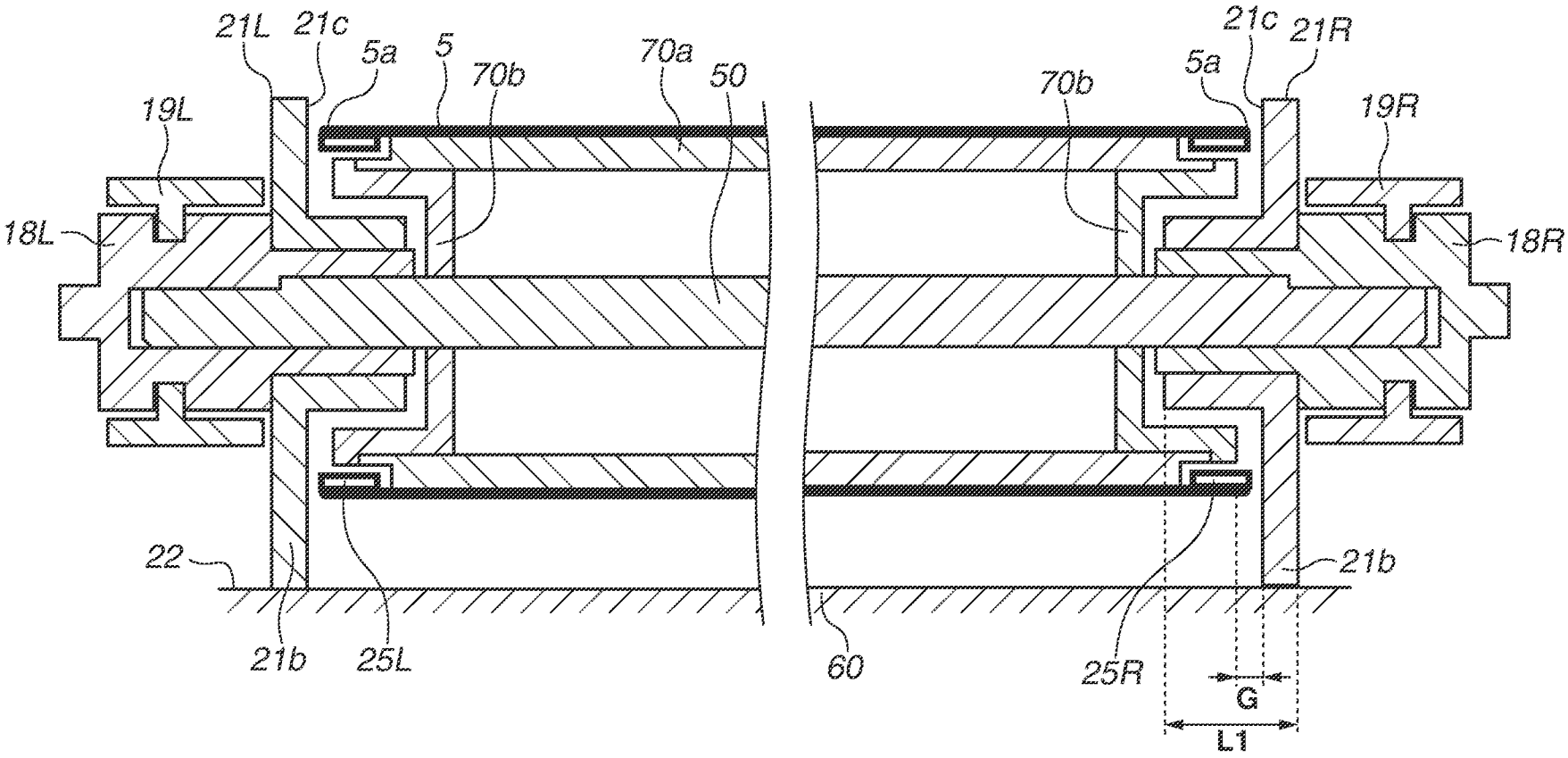
FIG. 16 is a schematic sectional view of another embodiment according to the variation of the first exemplary embodiment.

According to the variation of the present exemplary embodiment, a description has been provided of the configuration in which the tapes 25R and 25L for reinforcement are attached to outer circumferential surface sides of the intermediate transfer belt 105, but this is not restrictive. The tapes 25R and 25L may be attached to inner circumferential surface sides of the intermediate transfer belt 5 as illustrated in FIG. 16. In this case, it is necessary to make outer diameters of a sleeve 70*a* and a flange 70*b* smaller than an outer diameter of a belt stretching portion by a thickness of the reinforcing tape in an area in which the tapes 25R and 25L for reinforcement are in contact with a tension roller 70.

According to the present exemplary embodiment, the inner end surface 21*d* is included in the recessed portion 7*r* of the flange 7*b* for each of the adjustment members 21R and 21L on the both end sides in the belt width direction. However, the present disclosure is not limited to this configuration. The configuration according to the present exemplary embodiment may be adopted only to the one end side or the other end side in the belt width direction, and the conventional configuration may be adopted to the side to which the configuration according to the present exemplary embodiment is not adopted. However, the effects described in the present exemplary embodiment can be produced more effectively by adopting the configuration according to the present exemplary embodiment to the both end sides in the belt width direction.

Figure 17A:
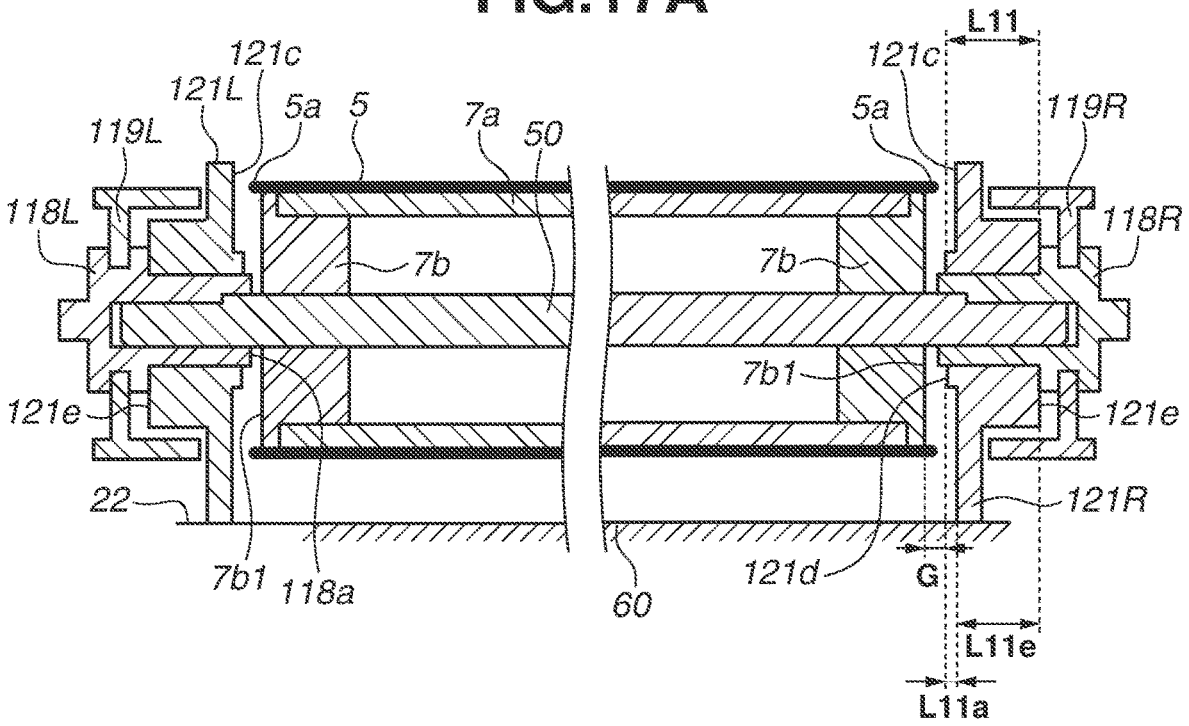
FIGS. 17A and 17B are schematic sectional views illustrating configurations and operations of an adjustment member according to a second exemplary embodiment.
Figure 17B:
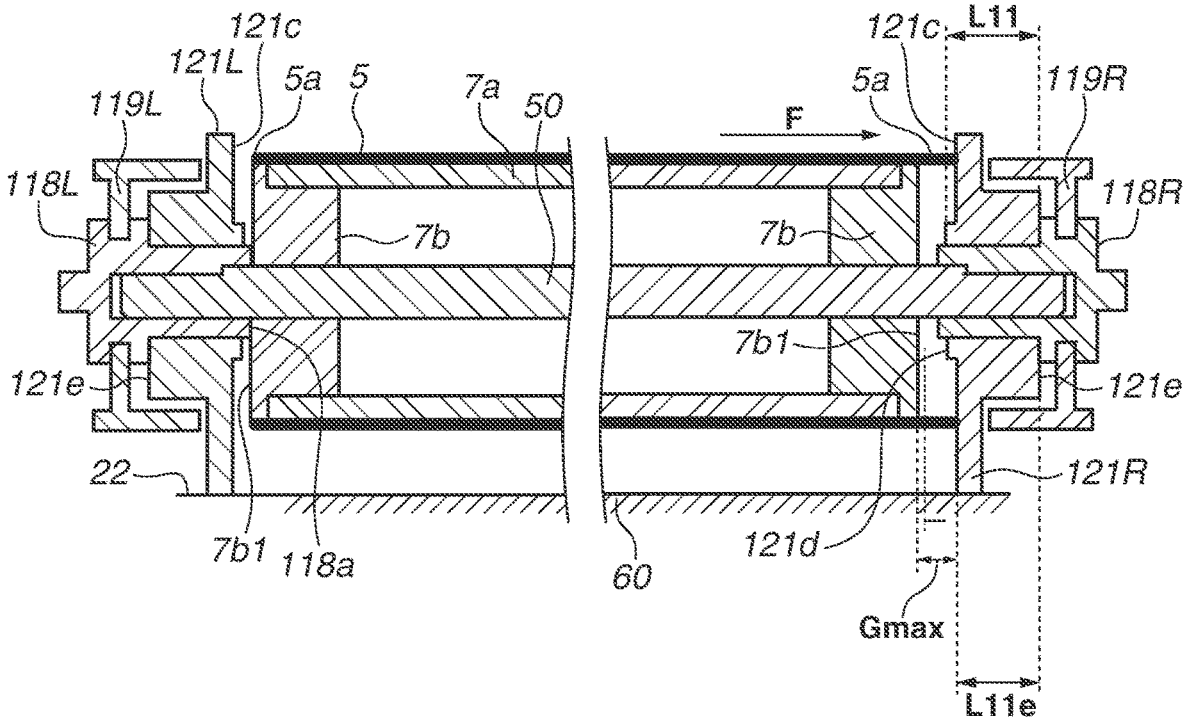

A second exemplary embodiment of the present disclosure will be described below. According to the first exemplary embodiment, the configuration has been described in which the recessed portion 7*r* provided in the flange 7*b* includes the part of the adjustment member 21R supported by the tension roller bearing 18R, and thus the gap G is narrowed compared with that in the conventional configuration (a similar configuration applies to the adjustment member 21L). In contrast, according to the second exemplary embodiment, a configuration for supporting adjustment members 121R and 121L is different from that in the first exemplary embodiment, as illustrated in FIGS. 17A and 17B. In the following description, except for the above-described difference, the configurations common to the first and the second exemplary embodiments are denoted by the same reference numerals, and descriptions thereof are omitted.

FIG. 17A is a schematic diagram illustrating a peripheral configuration of the adjustment members 121R and 121L in a state in which the intermediate transfer belt 5 is not shifted in the present exemplary embodiment. FIG. 17B is a schematic diagram illustrating the peripheral configuration of the adjustment members 121R and 121L in a state in which the intermediate transfer belt 5 is shifted. In the following description, regarding various members on the both end sides in the belt width direction, only the configuration on the R side, which is the one end side, will be described if the configuration and operation do not need to be particularly distinguished on both end sides, and the description of the configuration on the L side, which is the other end side, is omitted.

As illustrated in FIGS. 17A and 17B, according to the present exemplary embodiment, the both ends in the belt width direction of the rotating shaft 50 of the tension roller 7 are rotatably supported by tension roller bearings 118L and 118R which are bearing support members. The tension roller bearings 118L and 118R respectively are engaged with tension roller bearing holders 119L and 119R. Configurations and functions of the tension roller bearing holders 119L and 119R are substantially the same as those of the tension roller bearing holders 19L and 19R according to the first exemplary embodiment except their sizes, and thus, detailed descriptions thereof are omitted. The rotating shaft 50, the sleeve 7*a*, and the flange 7*b* integrally rotate with the rotation of the intermediate transfer belt 5.

As described in the first exemplary embodiment, the belt end portion 5*a* comes into contact with a belt sliding surface 121*c* of the adjustment member 121R, and thus, the adjustment member 121R provided on the outside of the tension roller 7 in the belt width direction rotates by receiving the frictional force derived from the shifting force from the belt end portion 5*a*. At that time, if the adjustment member 121R is tilted outward in the belt width direction with respect to the tension roller bearing 118R by the shifting force, the rotation for shift adjustment by the adjustment member 121R is hindered. Thus, also in the present exemplary embodiment, the adjustment member 121R has a certain support length L11 as a length supported by the tension roller bearing 118R as illustrated in FIG. 17A (a similar configuration applies to the adjustment member 121L).

As illustrated in FIG. 17A, a distance L11*a* between the belt sliding surface 121*c* and an inner end surface 121*d* is short in the adjustment member 121R. By contrast, the adjustment member 121R projects in a direction away from the flange 7*b* in the belt width direction, thus securing the support length L11 supported by the tension roller bearing 118R. A distance from an end surface of the belt sliding surface 121*c* to an outer end surface 121*e* of the adjustment member 121R in the belt width direction is a distance L11*e*. The support length L11 is a sum of the distance L11*a* and the distance L11*e*.

The outer end surface 7*b*1 (a first end portion) in the belt width direction in FIGS. 17A and 17B is an end surface which is provided at a position closest to the belt end portion 5*a*, is at a position closest to the belt sliding surface 121*c*, and faces the adjustment member 121R. The inner end surface 121*d* of the adjustment member 121R is an end surface which faces the outer end surface 7*b*1 of the flange 7*b* in the belt width direction. The outer end surface 121*e* (a second end portion) of the adjustment member 121R is an end surface which is provided at a position farthest from the belt sliding surface 121*c* in the adjustment member 121R.

As described above, the configuration according to the present exemplary embodiment can make the gap G between the outer end surface 7*b*1 of the flange 7*b* and the belt sliding surface 121*c* narrower than that in the conventional configuration while securing the support length L11 of the adjustment member 121R for a certain distance.

As illustrated in FIG. 17B, in a case where the intermediate transfer belt 5 is shifted in the direction of the arrow F in FIG. 17B by the shifting force, a reaction force is exerted on the tension roller 7, and each component is shifted to the side opposite to the direction of the arrow F in FIG. 17B within a range of backlash provided in the component. Then, the outer end surface 7*b*1 of the flange 7*b* comes into contact with an end portion of the tension roller bearing 118L on the adjustment member 121L side. In a case where the tension roller 7 is shifted to the side opposite to the direction of the arrow F in FIG. 17B and a part of the flange 7*b* comes into contact with the adjustment member 121L, it becomes a factor that contributes to hinder the rotation for shift adjustment. Thus, also in the present exemplary embodiment, the flange 7*b* is configured to be brought into contact with the tension roller bearing 118L so as not to come into contact with the adjustment member 121L in a case where the tension roller 7 is shifted.

In a state in which the flange 7*b* on the adjustment member 121L side is in contact with the tension roller bearing 118L, a gap Gmax appears between the outer end surface 7*b*1 and the belt sliding surface 121*c* on the adjustment member 121R side. The gap Gmax is the largest gap that can appear between the outer end surface 7*b*1 and the belt sliding surface 121*c* with the rotation of the intermediate transfer belt 5. According to the present exemplary embodiment, as illustrated in FIG. 17B, a length of the gap Gmax in the belt width direction is shorter than the distance L11*e* from the outer end surface 121*e* to the belt sliding surface 121*c* of the adjustment member 121R.

As described above, according to the present exemplary embodiment, the adjustment member 121R is projected, at a part of the portion supported by the tension roller bearing 118R, to the tension roller bearing holder 119R side, and thus the lengths of the gap G and the gap Gmax are set shorter than those in the conventional configuration. Thus, the present exemplary embodiment can reduce or prevent buckling of the belt end portion as compared with the conventional configuration, by setting the gap G and the gap Gmax narrower than those in the conventional configuration while maintaining an operation performance of the adjustment member 121R by securing the support length L11 of the adjustment member 121R (the same applies to the adjustment member 121L) for a certain distance.

Figure 18:
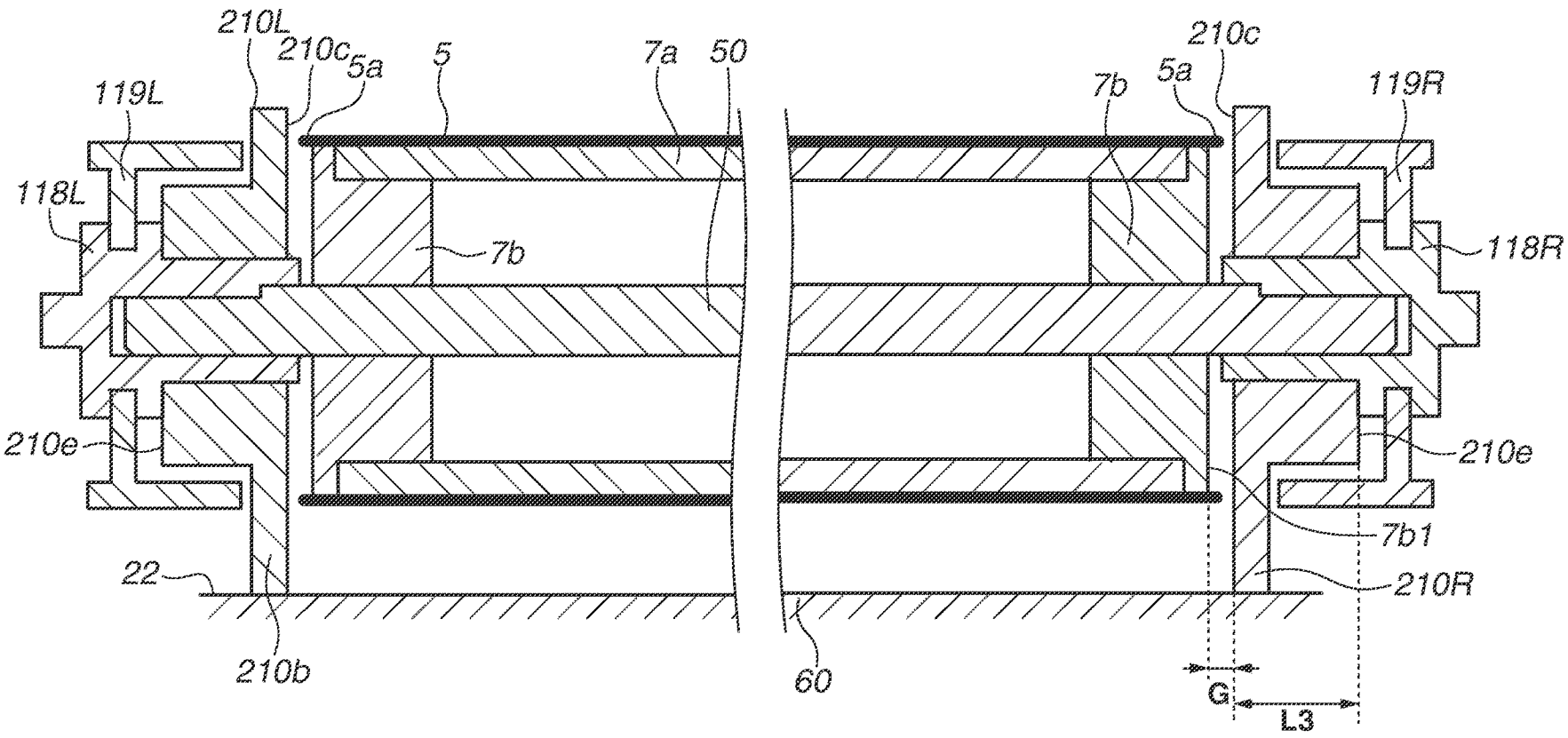
FIG. 18 is a schematic sectional view of a configuration according to a variation of the second exemplary embodiment.

FIG. 18 is a schematic diagram illustrating a variation of the present exemplary embodiment. In the present exemplary embodiment, the configuration has been described in which the inner end surface 121*d* and the belt sliding surface 121*c* of the adjustment member 121R are surfaces provided at different positions in the belt width direction as illustrated in FIGS. 17A and 17B, but this is not restrictive. Alternatively, an inner end surface of an adjustment member 210R may be formed on an extension of the same surface as a belt sliding surface 210*c* as illustrated in FIG. 18. Thus, a gap G between the outer end surface 7*b*1 and the belt sliding surface 210*c* of the adjustment member 210R can be further narrowed. In the variation illustrated in FIG. 18, the other configurations and operations are substantially the same as those in the present exemplary embodiment except that the configurations of the adjustment members 210R and 210L are different from those of the adjustment members 121R and 121L in the present exemplary embodiment.

According to the present exemplary embodiment, the adjustment member 121R is projected, at a part of the portion supported by the tension roller bearing 118R, is projected to the tension roller bearing holder 119R side (a similar configuration applies to the adjustment member 121L) with respect to each of the adjustment members 121R and 121L on the both end sides in the belt width direction. However, the present disclosure is not limited to this configuration. The configuration in the present exemplary embodiment may be adopted only to one end side or the other end side in the belt width direction, and the conventional configuration may be adopted to the side to which the configuration in the present exemplary embodiment is not adopted. However, the effects described in the present exemplary embodiment can be produced more effectively by adopting the configuration according to the present exemplary embodiment to the both end sides in the belt width direction.

According to the first and the second exemplary embodiments, the adjustment member for adjusting the shift of the intermediate transfer belt in the belt conveyance apparatus in which the intermediate transfer belt is stretched has been described. However, a belt conveyance apparatus to which the adjustment member according to the present disclosure can be adopted is not limited to the above-described embodiments. A similar effect can be produced in a belt conveyance apparatus which electrostatically bears and conveys a transfer material by applying the present disclosure. In other words, an image forming apparatus adopting a direct transfer system which transfers a toner image from a photosensitive drum serving as an image bearing member to a transfer material conveyed by a belt conveyance apparatus can produce the same effect by applying the present disclosure.

According to the present disclosure, a belt conveyance apparatus can be provided which can prevent or reduce buckling of a belt end portion while maintaining an operation performance of an adjustment member which adjusts a shift of a belt.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-116592, filed Jul. 6, 2020, which is hereby incorporated by reference herein in its entirety.

What is claimed is:

1. A belt conveyance apparatus comprising:

an endless belt configured to rotationally move;

a plurality of stretching members for stretching the endless belt;

an adjustment mechanism configured to adjust a shift of the endless belt, wherein, in a case where the endless belt is shifted to a first end side in a belt width direction orthogonal to a movement direction of the endless belt, the adjustment mechanism adjusts the shift of the endless belt by tilting one stretching member of the plurality of stretching members with respect to another stretching member; and bearings, wherein each bearing is for supporting a corresponding one of both end sides of the one stretching member in the belt width direction, wherein the adjustment mechanism includes first and second adjustment members and a link unit, wherein the first and second adjustment members are each disposed on the respective both end sides of the one stretching member in the belt width direction and configured to rotate by receiving a force from the endless belt, wherein the link unit is configured to link rotation of the first adjustment member to rotation of the second adjustment member, wherein, in a case where the endless belt is shifted to the first end side, the adjustment mechanism is configured to adjust the shift of the endless belt by tilting the one stretching member with respect to the other stretching member with the first adjustment member rotated by receiving the force from the endless belt and the second adjustment member rotated by the link unit, wherein the first and second adjustment members are each rotatably supported by an outer circumferential surface of the bearings, face an end portion of the endless belt stretched by the plurality of stretching members, and include a sliding surface which comes into contact with the end portion of the endless belt in a case where the endless belt is shifted, wherein the one stretching member includes a rotation unit which supports an inner circumferential surface of the endless belt and rotates with the rotation of the endless belt, and wherein, on the first end side or a second end side opposite to the first end side in the belt width direction, a distance from a first end portion, which is an end portion of the rotation unit at a position closest to the sliding surface, to the sliding surface is shorter than a distance from a second end portion at a position farthest from the sliding surface of the first adjustment member or the second adjustment member to the sliding surface.

2. The belt conveyance apparatus according to claim 1, wherein the rotation unit includes a sleeve configured to rotate with the rotation of the endless belt and a flange on an end portion of the sleeve in the belt width direction, and wherein the flange includes a recessed portion which is recessed in a direction from the bearings to the sleeve in at least one of the first end side and the second end side in the belt width direction, and the first adjustment member or the second adjustment member on a side having the recessed portion is disposed at a position at which the second end portion is included inside the recessed portion.

3. The belt conveyance apparatus according to claim 1, further comprising bearing holders, wherein each bearing holder is for holding the respective bearings on both end sides in the belt width direction, and wherein the second end portion of the first adjustment member or the second adjustment member is disposed on a side opposite to a bearing holder side with respect to the sliding surface, on at least one of the first end side and the second end side in the belt width direction.

4. The belt conveyance apparatus according to claim 1, further comprising bearing holders, wherein each bearing holder is for holding the respective bearings on both end sides in the belt width direction, and wherein the second end portion of the first adjustment member or the second adjustment member is disposed on a bearing holder side with respect to the sliding surface, on at least one of the first end side and the second end side in the belt width direction.

5. The belt conveyance apparatus according to claim 1, wherein a sheet-like protection member is attached to an outer circumferential surface side of both end portions of the endless belt in the belt width direction.

6. The belt conveyance apparatus according to claim 5, wherein a width of the sheet-like protection member is longer than a distance from the first end portion of the rotation unit on a side on which the sheet-like protection member is disposed to the sliding surface in the belt width direction.

7. The belt conveyance apparatus according to claim 1, wherein a sheet-like protection member is attached to an inner circumferential surface side of both end portions of the endless belt in the belt width direction.

8. The belt conveyance apparatus according to claim 7, wherein the sheet-like protection member is an adhesive tape including a polyester base material.

9. An image forming apparatus comprising:

the belt conveyance apparatus according to claim 1; and an image bearing member configured to bear a toner image, wherein the image forming apparatus forms an image by transferring the toner image from the image bearing member to a belt of the belt conveyance apparatus and then transferring the toner image from the endless belt to a transfer material.

10. An image forming apparatus comprising:

the belt conveyance apparatus according to claim 1; and an image bearing member configured to bear a toner image, wherein the image forming apparatus forms an image by transferring the toner image from the image bearing member to a transfer material which is electrostatically borne and conveyed by the belt conveyance apparatus.

* * * * *